US012736318B2

(12) United States Patent
Bressler et al.

(10) Patent No.: US 12,736,318 B2
(45) Date of Patent: Sep. 15, 2026

(54) AVALANCHE TRIGGERING APPARATUS

(71) Applicant: Alpine Infrastructure Inc., Tetonia, ID (US)

(72) Inventors: Eric Bressler, Tetonia, ID (US); Wade Wolf, Billings, MT (US)

( * ) Notice: Subject to any disclaimer, the term of this patent is extended or adjusted under 35 U.S.C. 154(b) by 4 days.

(21) Appl. No.: 19/189,679

(22) Filed: Apr. 25, 2025

(65) Prior Publication Data

US 2025/0264317 A1 Aug. 21, 2025

Related U.S. Application Data

(63) Continuation-in-part of application No. 18/444,660, filed on Feb. 17, 2024, now Pat. No. 12,332,039.

(51) Int. Cl.
*F42D 3/00* (2006.01)
*E01F 7/00* (2006.01)
(Continued)

(52) U.S. Cl.
CPC ..... *F42D 3/00* (2013.01); *E01F 7/00* (2013.01); *E01H 5/12* (2013.01); *F42D 1/045* (2013.01); *F42D 3/06* (2013.01)

(58) Field of Classification Search
CPC ... F42D 1/04; F42D 1/045; F42D 3/00; F42D 3/06; F42D 5/00; F41H 9/04; E01H 5/12; E01F 7/00; F42B 12/52
(Continued)

(56) References Cited

U.S. PATENT DOCUMENTS 5,107,765 A 4/1992 Schippers
5,864,517 A 1/1999 Hinkey et al.
(Continued)

FOREIGN PATENT DOCUMENTS

CH 713422 B1 11/2021
WO WO 2021/069839 A1 4/2021
(Continued)

OTHER PUBLICATIONS

The Gazex Avalanche Release System, Schppers, J et al. Source: Published In: International Snow Science Workshop 2002: 46-48 Publication Date: Sep. 1, 2002.
(Continued)

*Primary Examiner* — James S Bergin
(74) *Attorney, Agent, or Firm* — Antoinette M. Tease

(57) ABSTRACT

An avalanche triggering apparatus having a tower that is connected to a base and two detonation chambers. Two pairs of gas supply lines are configured to deliver fuel gas and an oxidizer to the two detonation chambers. Two spark plugs are configured to initiate combustion of gases within the detonation chambers when activated by one of two flow switches. One or more batteries are configured to provide electricity to the two spark plugs. The detonation chambers are connected to the tower via a central mounting assembly, two detonation mounting assemblies, and a plurality of isolator springs disposed between the central mounting assembly and each of the two detonation mounting assemblies. The central mounting assembly is comprised of a main gusset plate, two side plates, two rear plates, a top frame, and a bottom frame. Each detonation mounting assembly is comprised of a central plate and two side plates.

9 Claims, 27 Drawing Sheets

(51) Int. Cl.
*E01H 5/12* (2006.01)
*F42D 1/045* (2006.01)
*F42D 3/06* (2006.01)

(58) Field of Classification Search
USPC ..... 102/301, 302
See application file for complete search history.

(56) References Cited

U.S. PATENT DOCUMENTS

| | | | | |
|---|---|---|---|---|
| 6,279,481 | B1 | 8/2001 | Schippers | |
| 6,374,717 | B1 | 4/2002 | Schippers | |
| 7,707,938 | B2 * | 5/2010 | Hisel | F42B 12/52 102/302 |
| 8,904,939 | B2 * | 12/2014 | Constant | F42D 3/00 102/302 |
| 8,960,092 | B2 * | 2/2015 | Farizy | F42D 3/00 102/302 |
| 12,007,218 | B2 * | 6/2024 | Berthet-Rambaud | F42D 3/00 |
| 12,078,466 | B2 * | 9/2024 | Rivoal | E01F 7/04 |
| 12,332,039 | B1 * | 6/2025 | Bressler | F42D 1/045 |
| 2006/0254449 | A1 | 11/2006 | Hisel | |
| 2012/0318159 | A1 | 12/2012 | Constant et al. | |
| 2013/0133543 | A1 | 5/2013 | Farizy et al. | |
| 2026/0049801 | A1 * | 2/2026 | Basso | F42D 3/00 |

FOREIGN PATENT DOCUMENTS

| | | | |
|---|---|---|---|
| WO | WO 2021/255370 | A1 | 12/2021 |
| WO | WO 2022/258930 | A1 | 12/2022 |

OTHER PUBLICATIONS

International Search Report and Written Opinion in PCT?US25/10697; dated Mar. 7, 2025.
"Alta Ski Area" (Utah) Jul. 9, 2023; cited in ISR/WO.
"Using gas explosions to trigger avalanches remotely" (Instagram) Jan. 23, 2024; cited in ISR/WO.
"Wire Rope Isolators for Vibration Isoltuion" (Enidine); Sep. 22, 2023; cited in ISR/WO.

* cited by examiner

AVALANCHE TRIGGERING APPARATUS

CROSS-REFERENCE TO RELATED APPLICATION

Pursuant to 35 U.S.C. § 120, this application claims priority back to and is a continuation-in-part of U.S. patent application Ser. No. 18/444,660 filed on Feb. 17, 2024, the contents of which are incorporated herein by reference.

BACKGROUND OF THE INVENTION

1. Field of the Invention

The present invention relates generally to the field of avalanche control systems, and more particularly, to a remote-controlled avalanche triggering apparatus that incorporates a tower and a detonation chamber that are joined together with a plurality of isolator springs.

2. Description of the Related Art

Avalanches pose a risk to people and property. Avalanches have the ability to injure and kill people and cause significant and costly damage to property. An avalanche hitting an open highway or rail system can close transportation corridors and have financial impacts in the millions of dollars. The present invention aims to minimize avalanche risk to people and property by creating avalanches in an intentional and controlled manner and in predetermined locations. Solutions to the problem of unanticipated avalanches include both assessment and mitigation of avalanche risk. The present invention does not deal with the assessment of risk; it deals with mitigation of an identified risk.

Options that exist for avalanche mitigation include solid explosives, 105 mm high explosive (HE) howitzer rounds, skier-initiated avalanches a/k/a "ski cuts," passive defense (such as constructing avalanche dams, ditches, earth mounds, and terraces or employing methods such as reforestation and architectural streamlining), and Remote Avalanche Control Systems (RACS). RACS are designed to minimize exposure to the individual operating the system by using communication technology that creates distance between the operator and the point of avalanche initiation. RACS are further divided into two categories: solid explosive-based and gas-based systems. In some cases, the use of solid explosives for avalanche mitigation is not possible. Some reasons for this include Bureau of Alcohol, Tobacco, Firearms and Explosives (ATF) regulations, land management agency restrictions, proximity to infrastructure, and inability to store solid explosives. The present invention is a gas-based system that utilizes gas explosions to trigger avalanches. Although there are other gas-based systems currently in use, the present invention has several unique characteristics that make it attractive to potential users and distinguishable from the prior art.

U.S. Pat. No. 6,279,481 (Schippers, 2001) provides a device for provoking the collapse of a snow cornice comprising several exploders, each of which has a main cylinder that is perpendicular to a support base arranged flat on the ground and a positioning tube that is connected to the main cylinder and mounted on a rigid seat fixed to the mountain side. Supply conduits are configured to deliver oxygen, propane, and a detonating gas mixture into a positioning tube and then into the main cylinder. Igniting means, which are mounted upstream of the supply conduit, are configured to ignite the detonating gas mixture.

U.S. Patent Application Pub. No. 2012/0318159 (Constant et al.) discloses an avalanche-inducing device that is comprised of a tube, one closed end of which is mounted onto a holder in the form of a concrete mass that is attached to a mountainside. The other end of the tube is open and is rotated toward the snow cover. The device includes a means for filling the tube with an explosive gas mixture and a priming means for inducing an explosion. The device has two beams that are attached on one end to the holder and that extend along the tube parallel to it. These beams are intended to absorb the movement of the tube following explosion of the gas mixture.

U.S. Patent Application Pub. No. 2006/0254449 (Hisel) describes an apparatus and method for avalanche control in which two gases are combined to form a detonable mixture that is detonated near an avalanche start zone. The gases are supplied at pressures above ambient pressure in order to drive them through a mixer and deploy the gases in the form of a detonable cloud in open air near the start zone. An igniter is situated in proximity to the discharge point of the detonable cloud and in communication with a controller that fires the igniter based on predetermined time intervals. The explosive gas mixture is detonated in open air.

U.S. Pat. No. 5,107,765 (Schippers, 1992) involves a process and device for triggering an avalanche. The device consists of a rigid explosion tank with a closed rear end and a front opening. The tank is mounted in the direction of the slope on which the avalanche is to be triggered. The tank is connected to sources of fuel gas and oxygen, which are delivered into the tank via injection nozzles and which combine to form an explosive mixture. The individual components of the explosive mixture are delivered to the tank at a pressure above atmospheric, and they achieve atmospheric pressure when combined within the tank. An ignition device is mounted in the bottom of the tank and operated via remote control.

U.S. Pat. No. 6,374,717 (Schippers, 2002) provides a device for provoking an avalanche that is comprised of a gas gun, one end (the upstream end) of which is pivotally attached to a seat that is solidly anchored to the mountain. The other end of the gun is supported by a leg that is configured to hold the downstream end of the gun above the level of the snow cover. The leg is preferably hollow and contains ballast consisting of chippings or concrete. The upstream end of the gun is equipped with ignition mechanisms (spark plugs) that are configured to discharge the device.

U.S. Pat. No. 5,864,517 (Hinkey et al., 1999) discloses a pulsed combustion acoustic wave generator comprised of an elongate tubular barrel with an inlet end and an open outlet end, a fuel controller that is configured to dispense a controlled quantity of fuel into the inlet end of the barrel, an oxidant controller that is configured to dispense a controlled quantity of oxidant into the inlet end of the barrel, and an igniter. The igniter extends into the inlet end of the barrel and is controllable by an operator. During operation, the generator produces sequentially pulsed directed pressure waves of sufficient pressure to incapacitate individuals at whom the open end of the barrel is pointed while minimizing effects on the operator of the generator, provided that the operator is not in the direct path of the pressure waves. As described by the inventors, this device may be used to trigger avalanches.

U.S. Patent Application Pub. No. 2013/0133543 (Farizy et al.) describes a device for setting off an avalanche comprising a support that is affixed to a concrete slab and an enclosure with an open end that faces the snow cap. The invention includes means for filling the enclosure with an explosive gaseous mixture, firing means, and a remote-communication system. The enclosure is removably mounted on the support and carries both the firing means and the means of storing the gases that are used to form the gaseous mixture.

BRIEF SUMMARY OF THE INVENTION

The present invention is an avalanche triggering apparatus comprising: a tower having a first end, a second end, and a top part, the first end of the tower being connected to a base, and the top part of the tower being connected to two detonation chambers; two pairs of gas supply lines, each pair of gas supply lines being configured to deliver fuel gas and an oxidizer to one of the two detonation chambers; two spark plugs, each spark plug being configured to initiate combustion of gases within one of the two detonation chambers when activated by one of two flow switches; one or more batteries that are configured to provide electricity to the two spark plugs; and means for controlling remotely a flow of gas through the two pairs of gas supply lines; wherein the two detonation chambers are connected to the tower via a central mounting assembly, two detonation mounting assemblies, and a plurality of isolator springs disposed between the central mounting assembly and each of the two detonation mounting assemblies; wherein the central mounting assembly is comprised of a main gusset plate, two side plates, two rear plates, a top frame, and a bottom frame; wherein each of the two detonation mounting assemblies is comprised of a central plate and two side plates; wherein each of the two detonation chambers comprises a closed top end and an open bottom end; and wherein the open bottom end of each of the two detonation chambers is configured to face a snow surface.

In a preferred embodiment, the top frame of the central mounting assembly is roughly square in shape with a rearward opening and an interior recess that is configured to accept an outer circumference of the tower; wherein the interior recess of the top frame is configured to surround approximately three-quarters of the outer circumference of the tower; and wherein a front edge of the top frame has a width that is equal to a width of a top edge of the main gusset plate. The bottom frame of the central mounting assembly is preferably roughly square in shape with a rearward opening and an interior recess that is configured to accept an outer circumference of the tower; wherein the interior recess of the bottom frame is configured to surround approximately three-quarters of the outer circumference of the tower; and wherein a front edge of the bottom frame has a width that is equal to a width of a bottom edge of the main gusset plate.

In a preferred embodiment, each of the top frame, two rear plates, two sides plates, main gusset plate, and bottom frame of the central mounting assembly comprises a plurality of alternating keys and slots on at least one outer edge. Preferably, each of the two detonation chambers is positioned forwardly at a first angle in the range of ten degrees to twenty-five degrees relative to a vertical axis of the tower. Each of the two rear plates of the central mounting assembly has a front edge that is angled downwardly away from the vertical axis of the tower at a second angle, and the second angle is preferably equal to the first angle.

In a preferred embodiment, each of the two detonation chambers comprises a bottom end, and each of the two detonation chambers is splayed sideways so that the bottom ends of the two detonation chambers are at an angle in the range of ninety degrees to one hundred eighty degrees relative to each other. The central plate of the detonation chamber mounting assembly has four corners, each of the two side plates of the central mounting assembly has four corners, and the plurality of isolator springs are preferably mounted on the four corners of the central plates of each of the two detonation chamber mounting assemblies and the four corners of each of the two side plates of the central mounting assembly. In another preferred embodiment, the two flow switches are configured so that the spark plugs in both detonation chambers will ignite upon activation by either of the two flow switches.

REFERENCE NUMBERS

Figure 1:
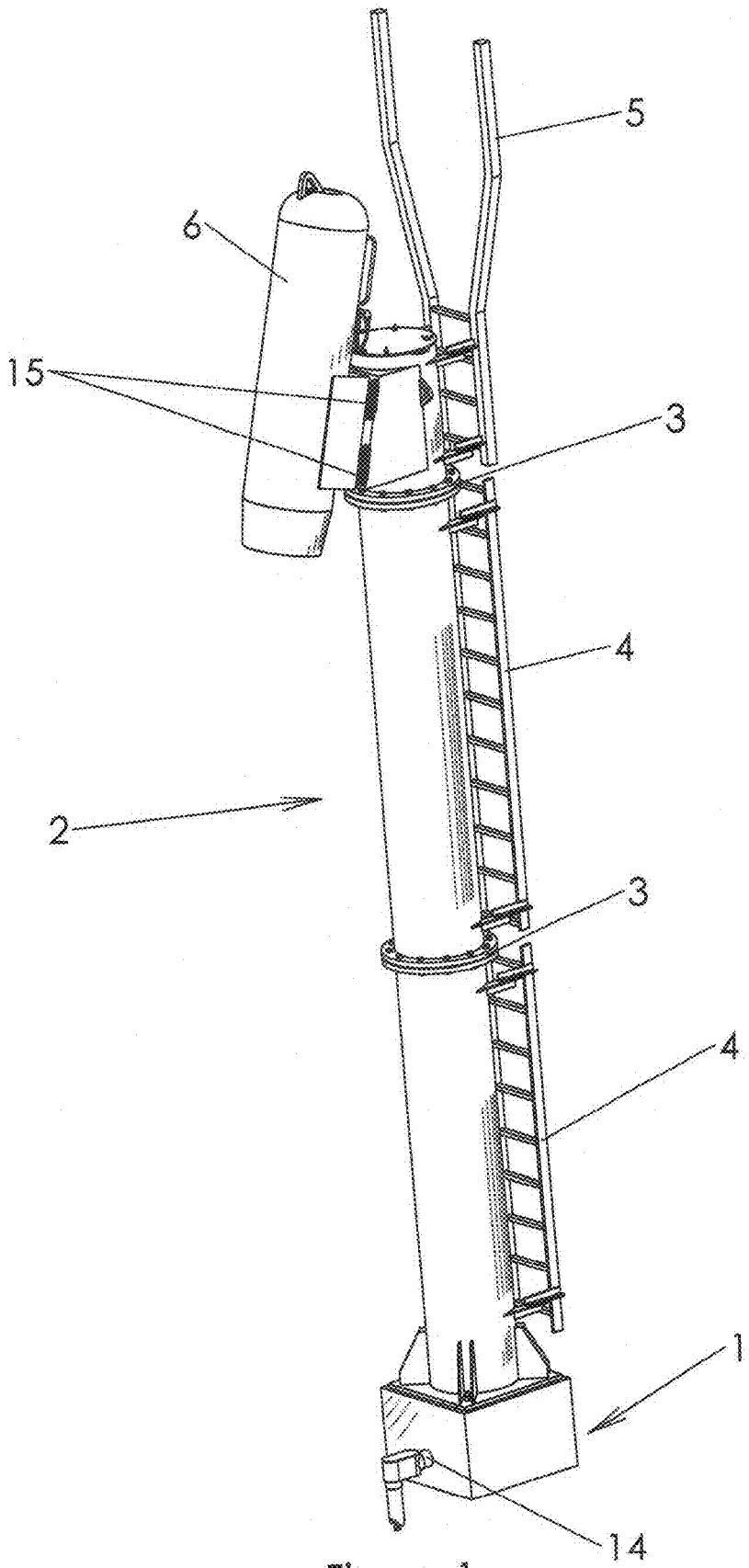
FIG. 1 is a first perspective view of the present invention.

1 Base
2 Tower
3 Flange
4 Ladder
5 Handrail
6 Detonation chamber
6*a* Top end (of detonation chamber)
6*b* Bottom end (of detonation chamber)
7 Mounting bracket
7*a* First mounting bracket
7*b* Side member (of first mounting bracket)
7*c* Front plate (of first mounting bracket)
7*d* Second mounting bracket
7*e* Side member (of second mounting bracket)
7*f* Front plate (of second mounting bracket)
8 Cover plate
8*a* Overhanging lip (of cover plate)
9 Lifting bracket
10 Handle (of cover plate)
11 Gas supply line
12 Cover (for spark plug)
13 Electrical cable
14 Port (on base)
15 Isolator spring
15*a* Helical cable isolator (of isolator spring)
15*b* Aluminum member (of isolator spring)
16 Ignition box
17 Battery
18 Capacitor
19 Voltage converter
20 Terminal block
21 Pipe union
22 Signal wire
23 Flow switch
24 Grip handle
25 Spark plug
26 Splice (in gas line)
27 Central mounting assembly (dual-head, side-by-side alternate embodiment)
28 Rear plate (of central mounting assembly)
29 Bracket
30 Bolt
31 Lifting lug
32 Side plate (of central mounting assembly)
33 Main gusset plate
34 Side plate (of detonation chamber mounting assembly)
35 Central plate (of detonation chamber mounting assembly)
36 Gusset plate (of detonation chamber mounting assembly)
37 Bracket (supporting ignition box)
38 Detonation chamber mounting assembly
39 Check valve
40 Top frame (of central mounting assembly)
41 Supporting plate (of central mounting assembly)
42 Bottom frame (of central mounting assembly)

DETAILED DESCRIPTION OF INVENTION

A. Overview

Highway departments, ski resorts, railways, utility companies and mining operations all have a need to create avalanches in areas that expose people and property to avalanche risk. The present invention is a RACS that uses a mixture of gases to produce an air blast at the snow surface. The gas is delivered to and mixed within the detonation chamber part of the exploder and is ignited using a spark. The resulting explosion creates a shockwave that produces a pressure wave. This pressure wave is typically strong enough to initiate a fracture of the slab within the snowpack. When conditions are prime for triggering, the pressure wave creates an avalanche. Because of this conditional relationship between the snowpack and the exploder, assessment and prediction is critical to the success of the effects of the exploder. In other words, the exploder does not create avalanches on command but rather requires the operator to understand the proper timing of conducting mitigation work and creating avalanches.

Traditional (non-RACS) methods of avalanche triggering involve transport, delivery and detonation of solid explosives by individual avalanche workers. This is typically accomplished on foot/skis or from helicopters. Although this method is widely used, it is time-intensive and exposes the avalanche worker to risk of injury. With the present invention, the risk to workers is minimized, and avalanches are created more efficiently. The exploder is controlled by the operator from a safe distance.

The present invention has five main component parts. These parts include the tower, the detonation chamber, the spark/igniter, gas supply, and gas management/delivery. The tower is permanently installed via a concrete base that is anchored to the ground. The detonation chamber is attached to the tower, and the spark/igniter is threaded into the detonation chamber. The gas management/delivery system is a series of hoses, valves, regulators and electronic controls that run between the gas supply and the exploder. The details of the present invention are discussed more fully below.

B. Detailed Description of the Figures

Figure 2:
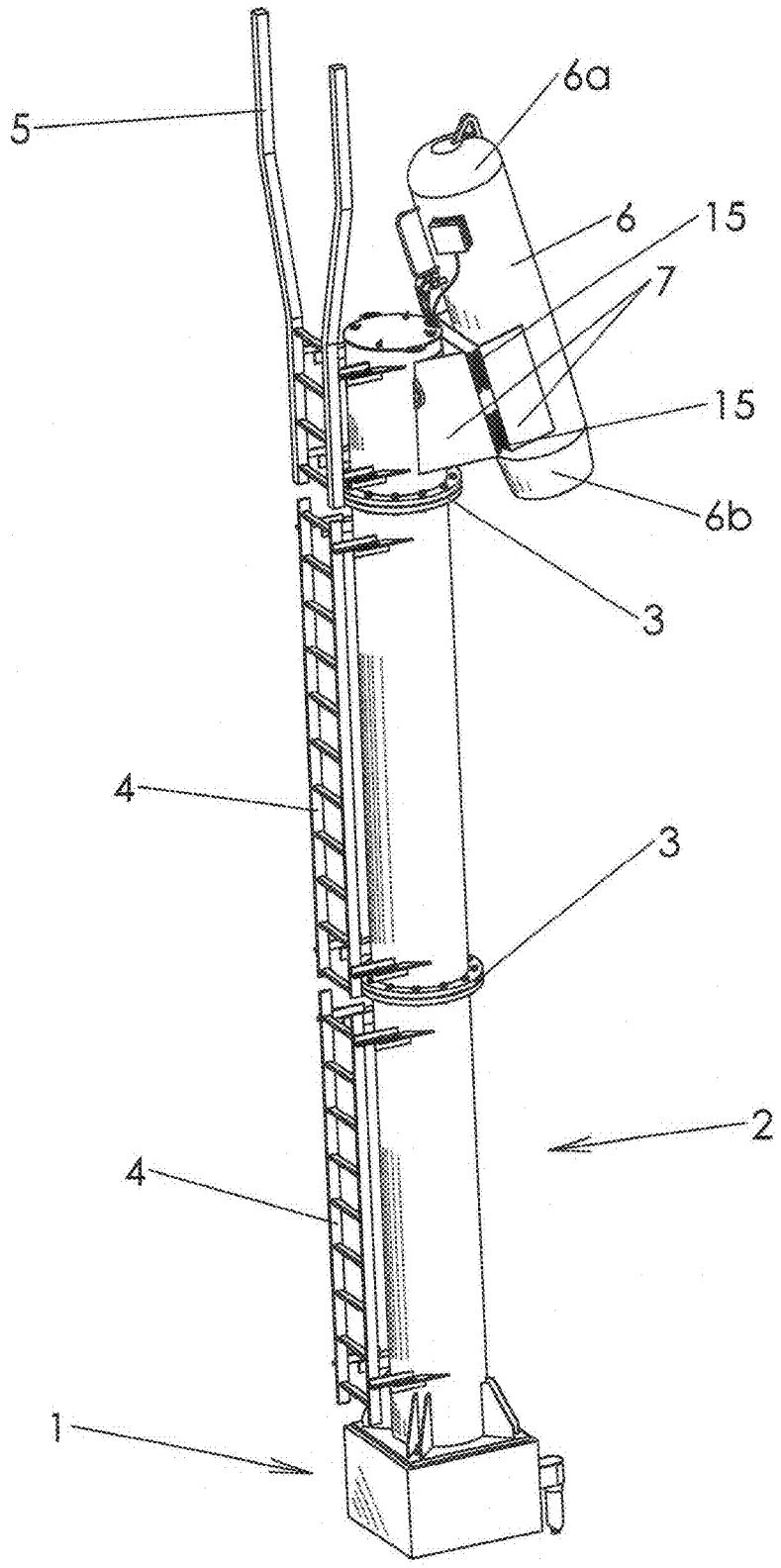
FIG. 2 is a second perspective view of the present invention.

FIG. 1 is a first perspective view of the present invention, and FIG. 2 is a second perspective view of the present invention. As shown in these two figures, the invention is comprised of a base 1, which in a preferred embodiment is a concrete platform that is permanently secured to the ground via anchor bolts (not shown). The invention is installed in an avalanche starting zone, and the concrete base 1 is prepped and poured onsite, typically in remote and rugged mountainous terrain.

Extending vertically upright from the base is the tower 2. The tower 2 may be comprised of one or more sections that are secured together via flanges 3. By installing the tower 2 in sections via flanges 3, the overall height of the tower 2 can be adjusted as necessary for a given installation. A ladder 4 is disposed along one side of the tower 2. The ladder 4 may be comprised of one or more sections, as shown. The top of the ladder 4 preferably comprises a handrail 5 that is configured to support a person who has climbed to the top of the ladder.

Figure 12:
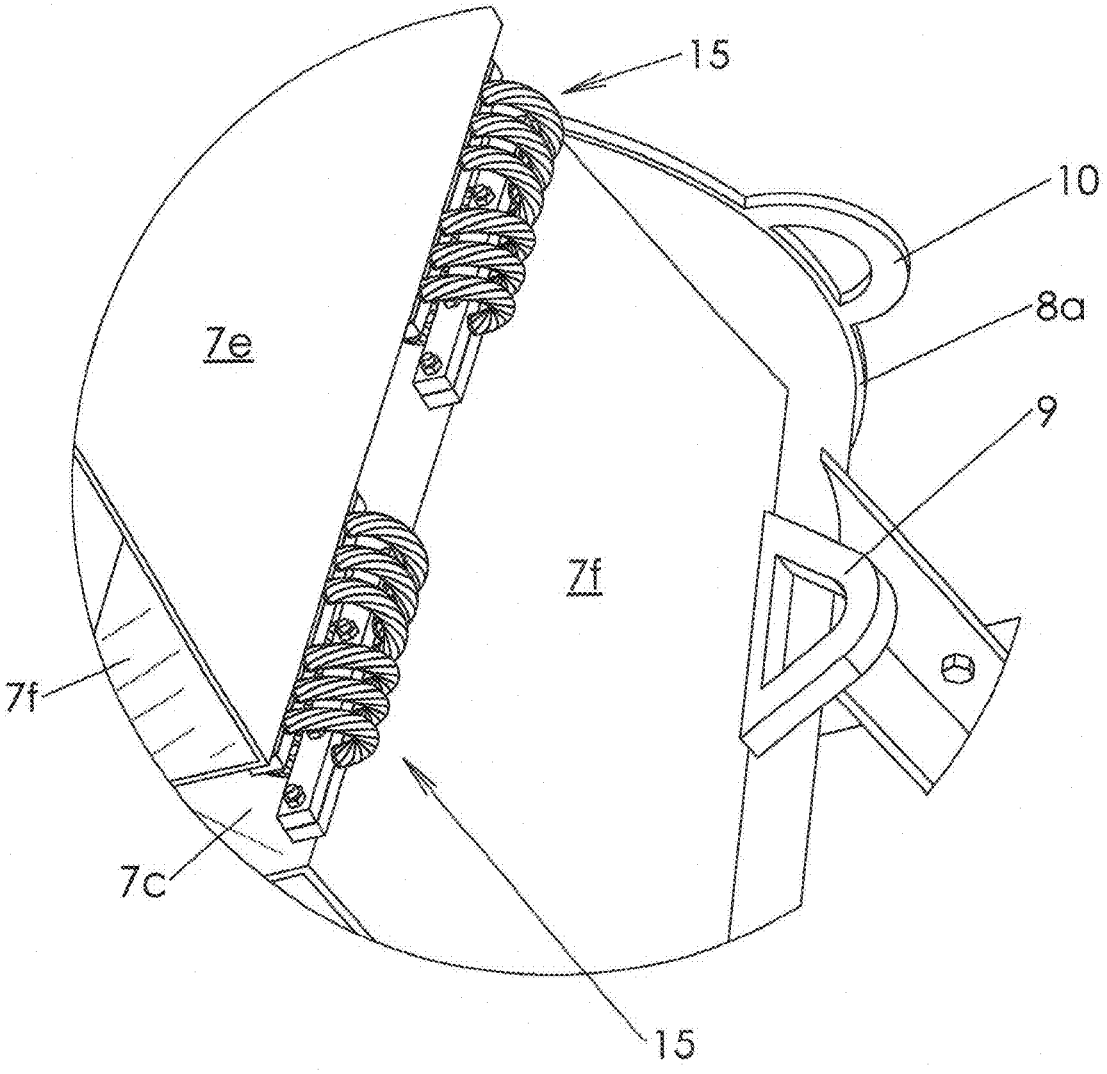
FIG. 12 is a detail view of the overhanging lip of the cover plate at the top of the tower.

The detonation chamber 6 is positioned at the top of the tower 2 and attached to the tower with a pair of mounting brackets 7 that are connected to each other via four pairs of isolator springs 15. The detonation chamber 6 is preferably cylindrical in shape. The mounting brackets 7 and isolator springs 15 are discussed in further detail in connection with FIG. 7. The tower 2 has a closed bottom end (which abuts up against the base 1) and a closed top end that is covered by a cover plate 8. The cover plate preferably has a slightly greater diameter than the top of end of the tower 2 so that the cover plate forms an overhanging lip 8*a* (see FIG. 12); in this manner, the cover plate 8 is fully supported by the top end of the tower. The detonation chamber 6 comprises a closed top end 6*a* and an open bottom end 6*b*, and the bottom end 6*b* is configured to face the snow surface. In a preferred embodiment, the detonation chamber 6 is at a 15-degree angle relative to the tower 2 (see FIG. 3). The cover plate 8 preferably comprises opposing handles 10 for ease of handling.

Gas supply lines 11 are configured to deliver oxygen and a combustible gas to the detonation chamber 6. A cover 12 in the form of a box is situated on the exterior of the detonation chamber 6 houses the spark plug (see FIG. 10), which is activated by a flow switch 23 (see FIG. 9), The cover 12 prevents ice and snow from accumulating on the spark plug 25. An electrical cable 13 connects the spark plug to a source of electricity (in this case, a battery 17 inside of the ignition box 16). In a preferred embodiment, the battery is a 12-volt, DC 1.2 Ah capacity sealed lead acid battery; however, the present invention is not limited to any particular type or size of battery as long as it is sufficient to supply the needed power to the spark plug.

Figure 3:
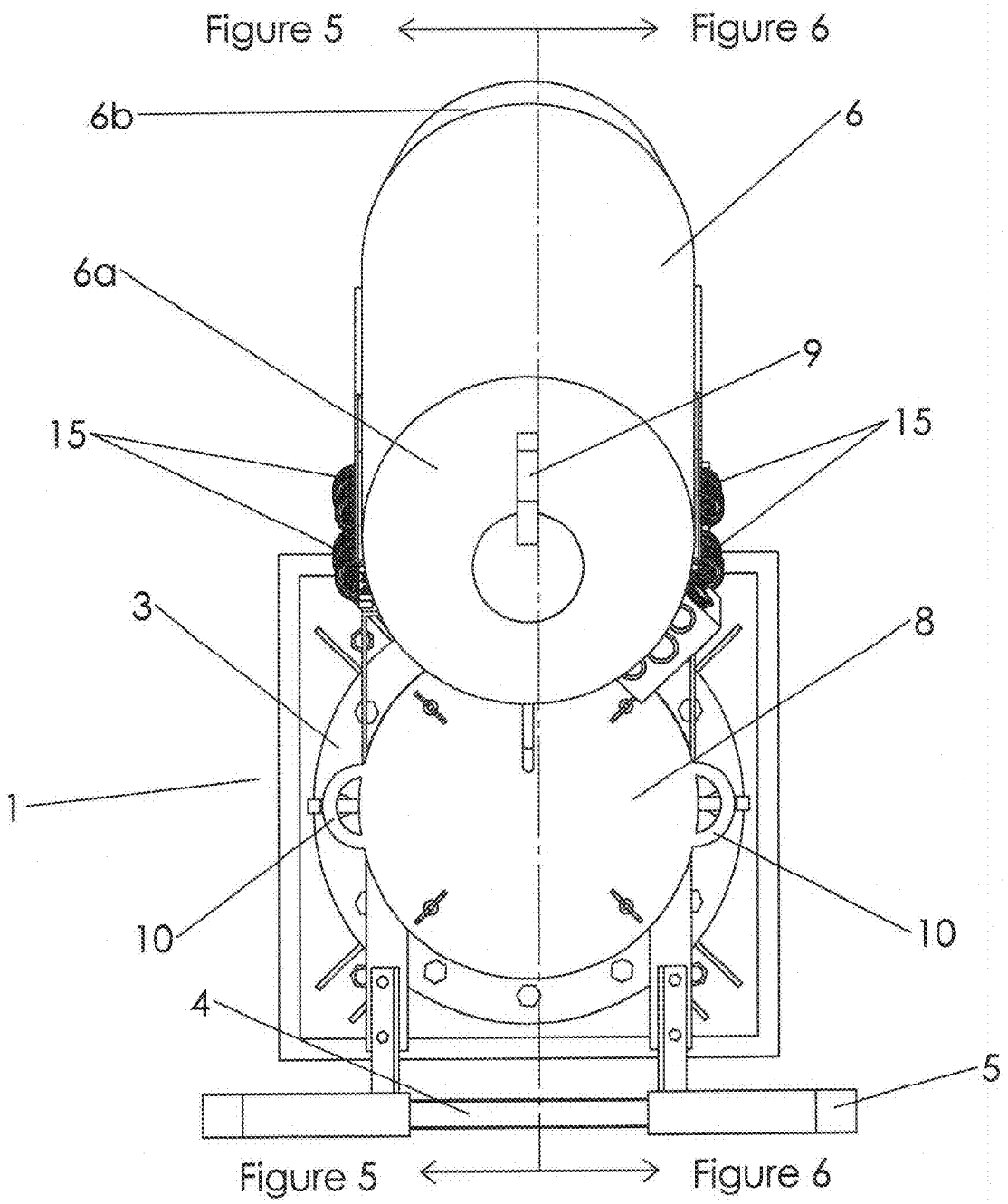
FIG. 3 is a side view of the present invention.

FIG. 3 is a side view of the present invention. As shown in this figure, the base 1 comprises a port 14 that is configured to receive the two gas supply lines 11, which run vertically up the length of the tower 2 (see FIG. 5). This figure also shows the shock-absorbing coils or isolator springs 15 that connect the two mounting brackets 7.

Figure 4:
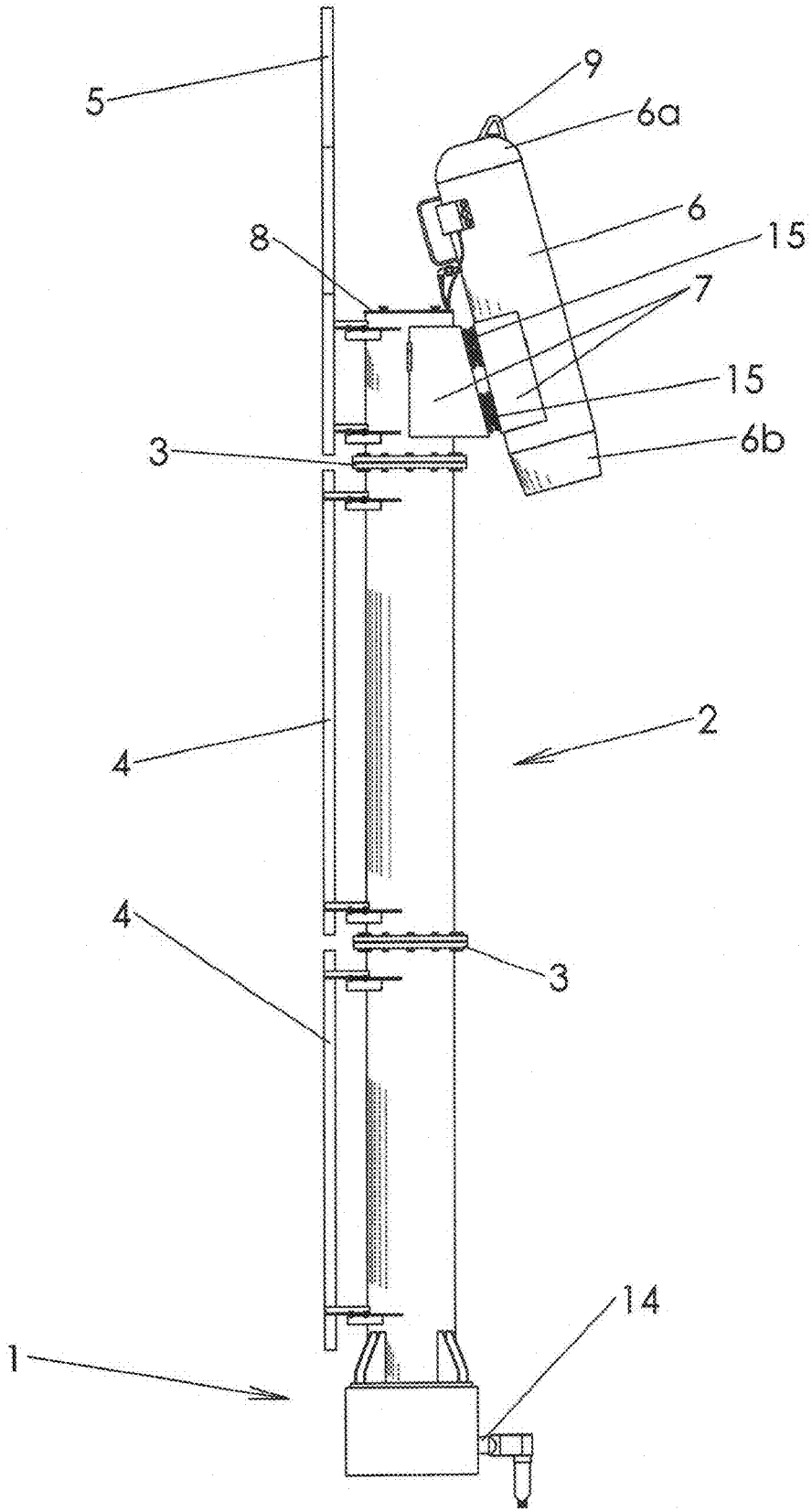
FIG. 4 is a top view of the present invention.
Figure 5:
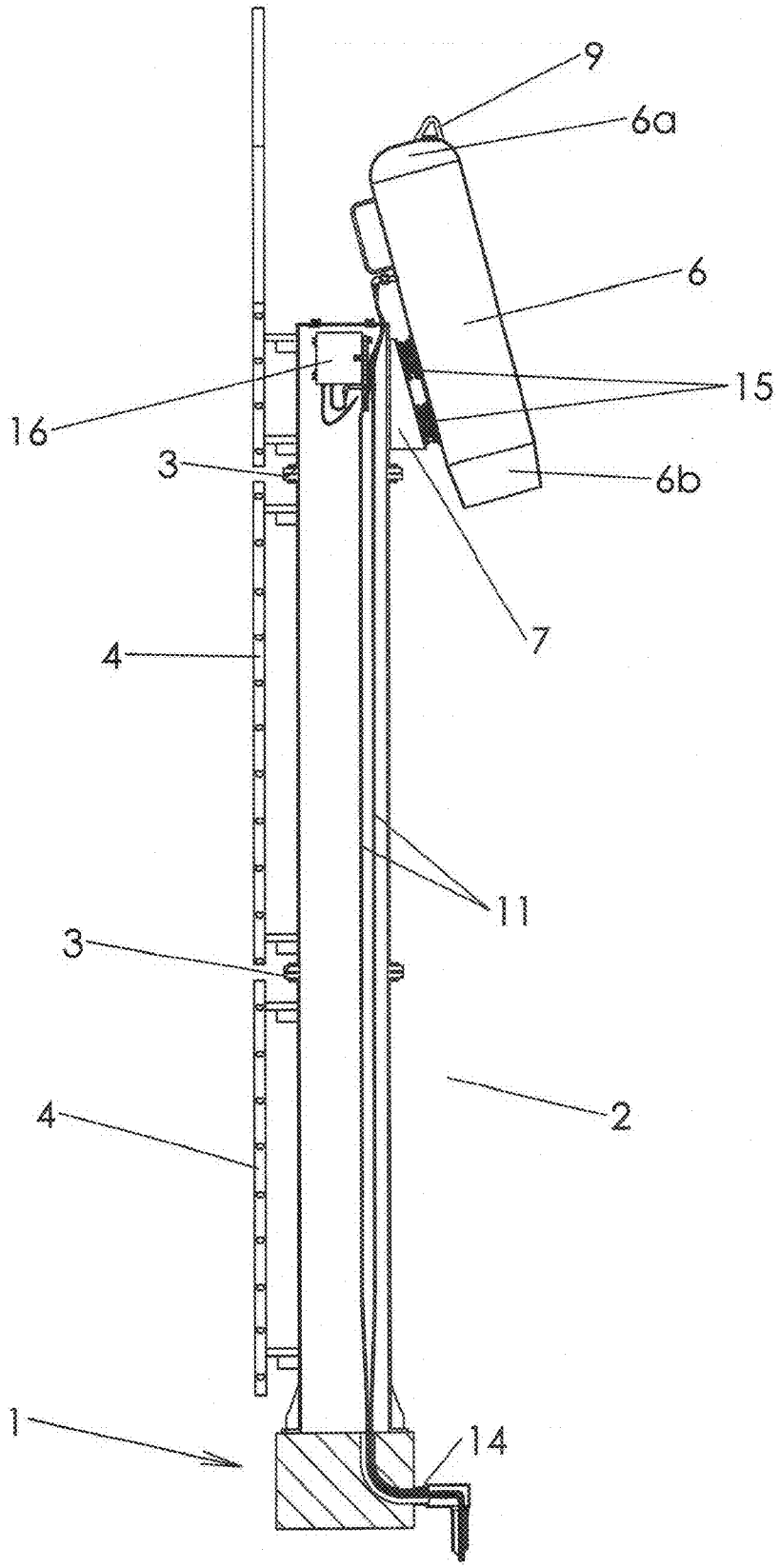
FIG. 5 is a section view of the present invention taken at the line shown in FIG. 4.
Figure 6:
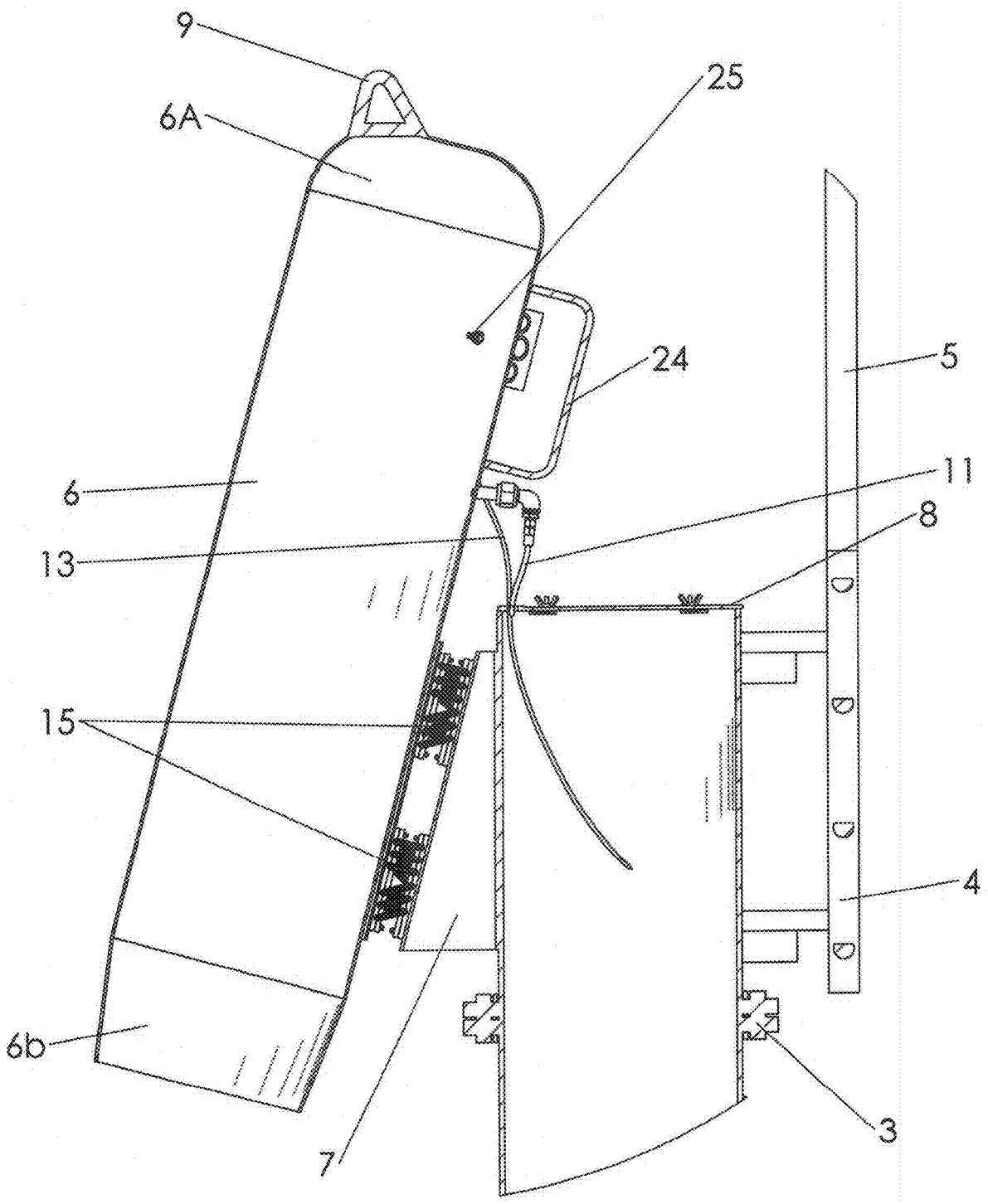
FIG. 6 is a section view of the detonation chamber and the top part of the tower taken at the line shown in FIG. 4.

FIG. 4 is a top view of the present invention. This figure shows where the section views of FIGS. 5 and 6 are taken. It also shows that the tower 2 is preferably cylindrical in shape with a constant outer diameter from top to bottom. The base 1 is preferably in the form of a square (when viewed from the top of the base), and the outer diameter of the tower is preferably less than the outer diameter of the base. The top end of the detonation chamber 6 is preferably rounded, as shown in this and the preceding figures, to prevent snow from accumulating on top of the detonation chamber. Both the detonation chamber 6 and the top end of the tower 2 preferably comprise lifting brackets 9 for ease of lifting and transportation (see also FIG. 7).

FIG. 5 is a section view of the present invention taken at the line shown in FIG. 4, and FIG. 6 is a section view of the detonation chamber and the top part of the tower taken at the line shown in FIG. 4. As shown in these two figures, the gas supply lines 11 run from the base 1 to the top of the tower 2. See discussion of FIGS. 8 and 9, below, for further details. A spark plug 25 is situated inside of the detonation chamber 6 and configured to initiate combustion of the gases within the detonation chamber 6 when activated (see also FIG. 10).

Figure 7:
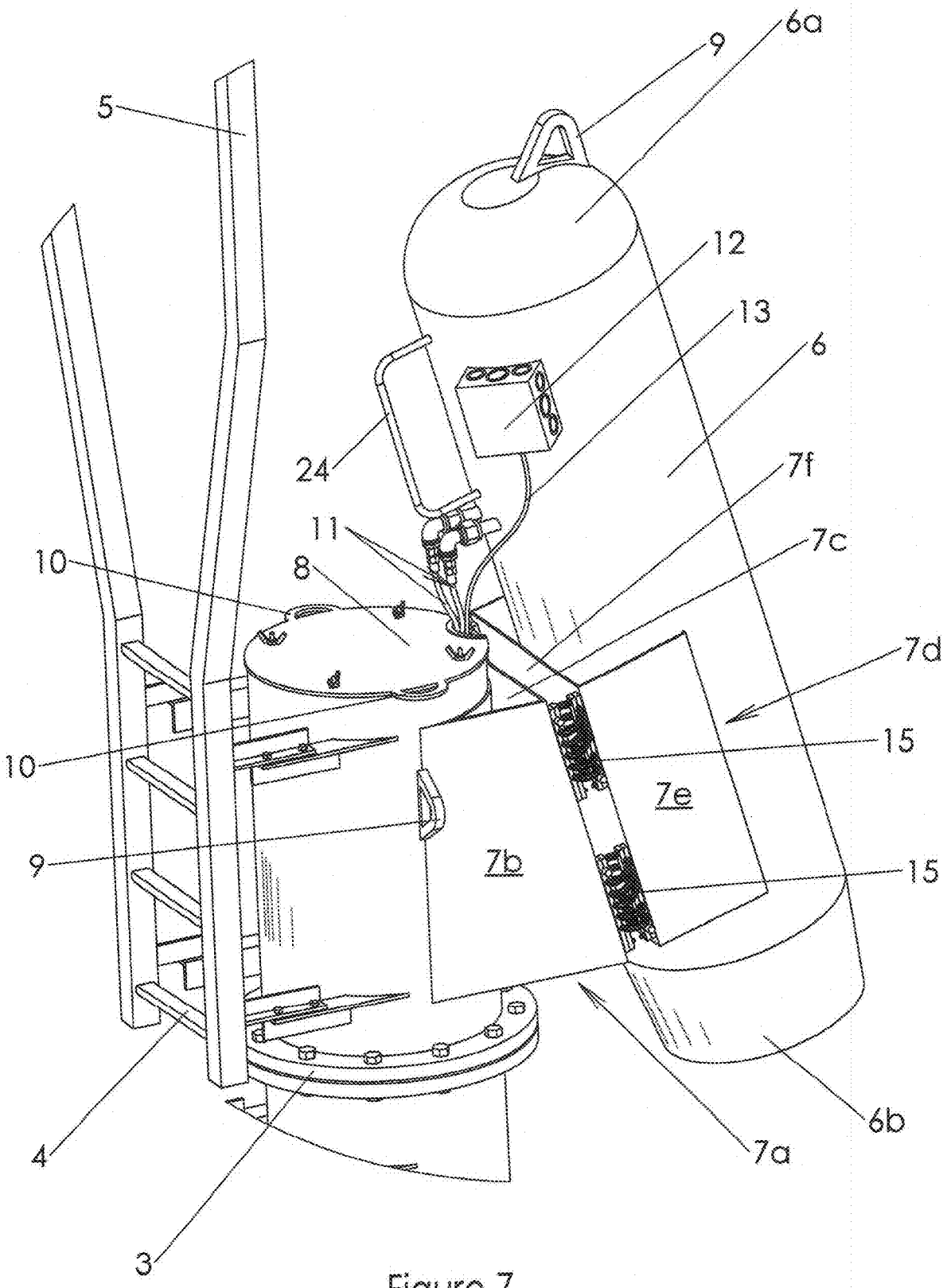
FIG. 7 is a perspective view of the detonation chamber and the top part of the tower.

FIG. 7 is a perspective view of the detonation chamber and the top part of the tower. As shown in this figure, a first mounting bracket 7*a* is attached to the top part of the tower 2 and is comprised of two side members 7*b* and a front plate 7*c*. The two side members 7*b* are attached to either side of the top part of the tower 2, and the front plate 7*c* extends across the front of the top part of the tower and connects the two side members. A second mounting bracket 7*d* is attached to the detonation chamber and is comprised of two side members 7*e* and a front plate 7*f*. The two side members 7*e* are attached to either side of the detonation chamber, and the front plate 7*f* extends across the back of the detonation chamber and connects the two side members. Note that the first mounting bracket 7*a* is configured so that the front plate 7*c* is at the same angle as the detonation chamber 6 (as noted above, preferably a fifteen-degree angle). In this manner, there is a constant distance between the front plate 7*c* of the first mounting bracket 7*a* and the front plate 7*f* of the second mounting bracket 7*d*. The front plate 7*c* of the first mounting bracket 7*a* has the same width as the front plate 7*f* of the second mounting bracket 7*d*, which means that the outer diameter of the tower 2 is approximately the same as the outer diameter of the detonation chamber 6. A first pair of isolator springs 15 is oriented so that one isolator spring 15 is on top of the other. This pair of isolator springs is situated in between the front plates 7*c*, 7*f* of the mounting brackets 7*a*, 7*d*. Each isolator spring 15 is comprised of a helical cable isolator 15*a* that is inserted through plurality of holes in two aluminum members 15*b* in a helical configuration. (That is, the cable isolator itself is comprised of helically wound wire rope, and the cable isolator is helically wound or inserted into the plurality of holes in the aluminum members.) The aluminum members 15*b* are used to maintain the cable isolator in a helically wound configuration and to secure the isolator springs 15 to the front plates 7*c*, 7*f*. One pair of isolator springs 15 is situated on a first side of the mounting brackets 7*a*, 7*d*, and an identical pair of isolator springs is situated on a second side of the mounting brackets. Note that the angle between the side members and the front plate on each of the mounting brackets 7*a*, 7*e* is preferably ninety degrees.

The isolator springs 15 are intended to absorb the forces created by an explosion in the detonation chamber 6, thereby prolonging the overall life of the system. Specifically, the isolator springs 15 help to minimize the strain on the tower itself. Over time, the impact of the explosions will degrade the connection between the tower and the detonation chamber, at which point the detonation chamber can be removed and replaced. The detonation chamber is removed by removing the bolts that secure the isolator springs 15 to the first mounting bracket 7*a* and lifting the detonation chamber by helicopter.

Figure 8:
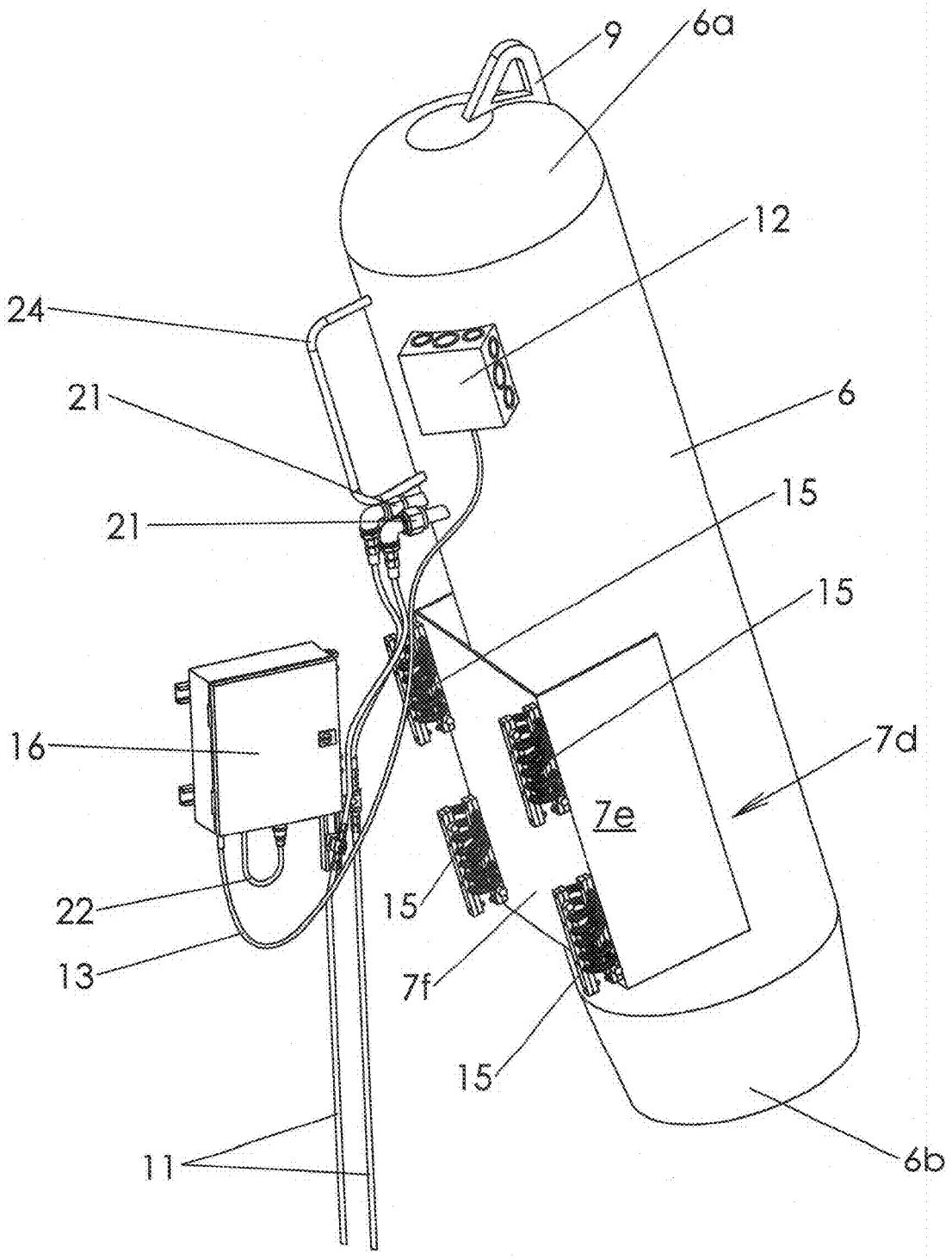
FIG. 8 is the same view as is shown in FIG. 7 but with the ladder, tower, cover plate, and one of the two mounting brackets removed.
Figure 9:
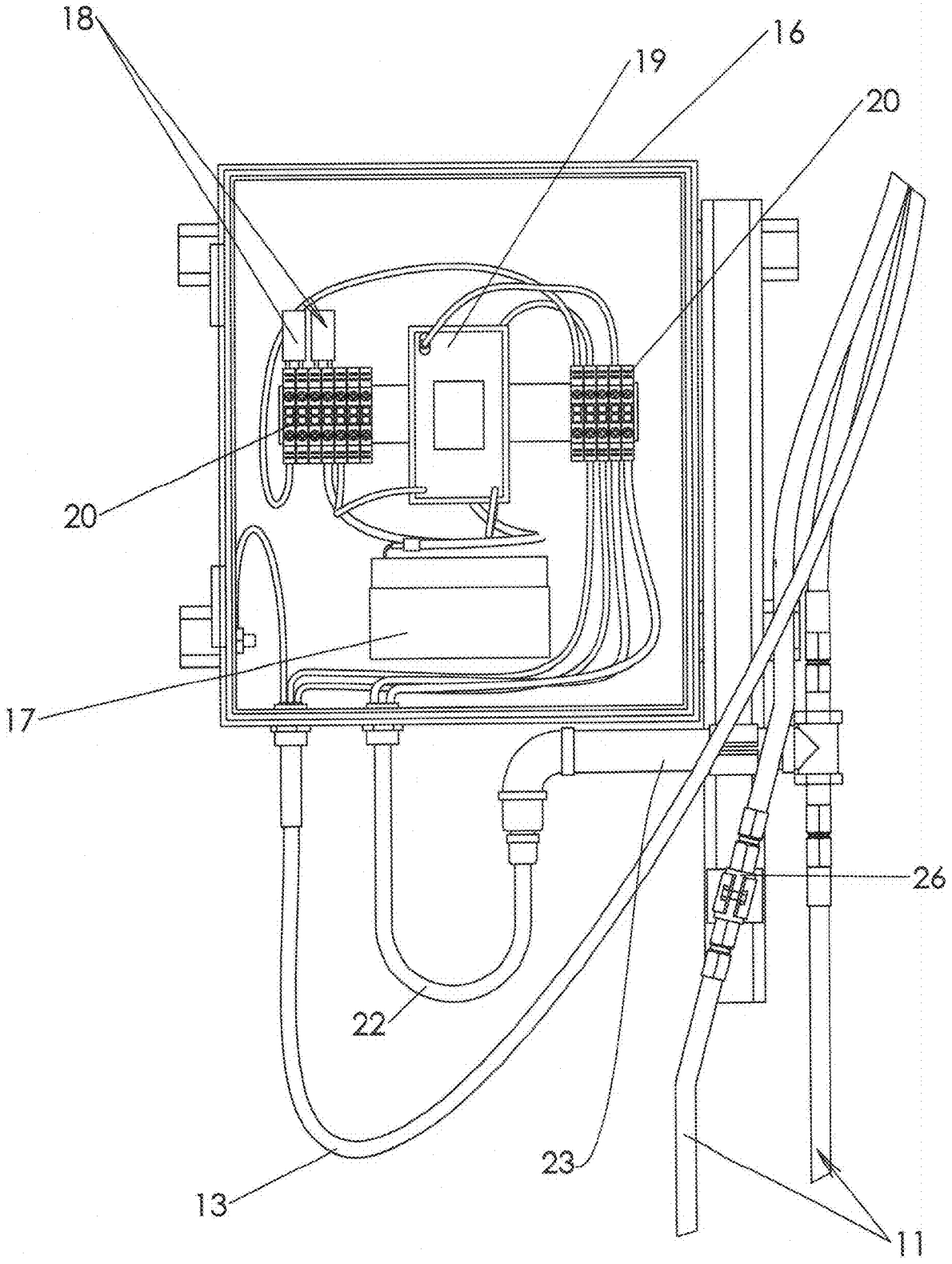
FIG. 9 is a detail view of the control box of the present invention.

FIG. 8 is the same view as is shown in FIG. 7 but with the ladder, tower, cover plate, and one of the two mounting brackets removed. As noted above in connection with FIG. 2, the electrical cable 13 runs from the ignition box 16 to the spark plug 25. A signal wire 22 is connected to a flow switch 23, which is shown in FIG. 9. Each gas supply line 11 connects to the detonation chamber 6 at a pipe union 21. Inside of each pipe union 21 is a check valve (not shown). In a preferred embodiment, the check valve is a spring-loaded piston check valve manufactured by McMaster-Carr of Elmhurst, Illinois. The pipe unions 21 are preferably slanted downward to prevent any snow or sleet that might blow up into the detonation chamber from entering the gas supply lines. Note that the detonation chamber 6 preferably comprises a grip handle 24, which can be used by the operator to steady himself when standing on top of the tower 2. One could also attach a positioning lanyard (not shown) to the grip handle 24.

FIG. 9 is a detail view of the ignition box of the present invention. In a preferred embodiment, the ignition box 16 is situated on the inside wall of the tower. The ignition box 16 contains a battery 17, two capacitors 18, a voltage converter 19, and two terminal blocks 20. Although two capacitors are shown here, the present invention would also work with a single capacitor. The voltage converter 19 converts 12-volt input (stored in the capacitor(s) from the battery) to 1.5 kilovolt output for the spark plug. The electrical cable 13 runs from the ignition box to the spark plug. A signal wire 22 runs from the ignition box to the flow switch 23. This figure shows the two gas lines 11, one of which preferably comprises a splice 26. The splice 26 is optional but facilitates seasonal testing of the gas lines. The other gas line 11 (that is, the one that does not have the splice) is connected to the flow switch 23. In a preferred embodiment, the gas line that is connected to the flow switch transports the fuel gas, which may be hydrogen or methane. The gas line that is not connected to the flow switch contains the oxidizer, which is typically oxygen. In this manner, the flow switch, which is configured to trigger the spark plug, is based on the flow of fuel gas only.

In the particular configuration shown in FIG. 9, three wires extend out of the top of the right-hand terminal block 20. The first of these wires goes to the left-hand terminal block, which is connected to the capacitors 18; this wire is referred to as the "common" contact. The second wire goes to the voltage converter 19 (also referred to below as the "spark generator"), and the third wire goes to the battery 17. When gas flow begins, it triggers the flow switch 23 to connect the capacitor(s) 18 to the battery 17; therefore, while gas flow is occurring, the capacitor(s) is/are charging from the battery. When gas flow stops, the capacitor(s) is/are disconnected from the battery and connected to the voltage converter 19. The voltage converter drains the capacitor(s) completely and remains connected to the capacitor(s) until the flow switch 23 is reactivated. All switching is done within the brass body of the flow switch 23, which acts as a sensor to detect the flow of fuel gas. Gas flow is controlled remotely using control hardware that is kept at a gas storage facility separate and apart from the tower. The gas supply lines 11 run from the gas storage facility to the port 14 at the base of the tower.

Figure 10:
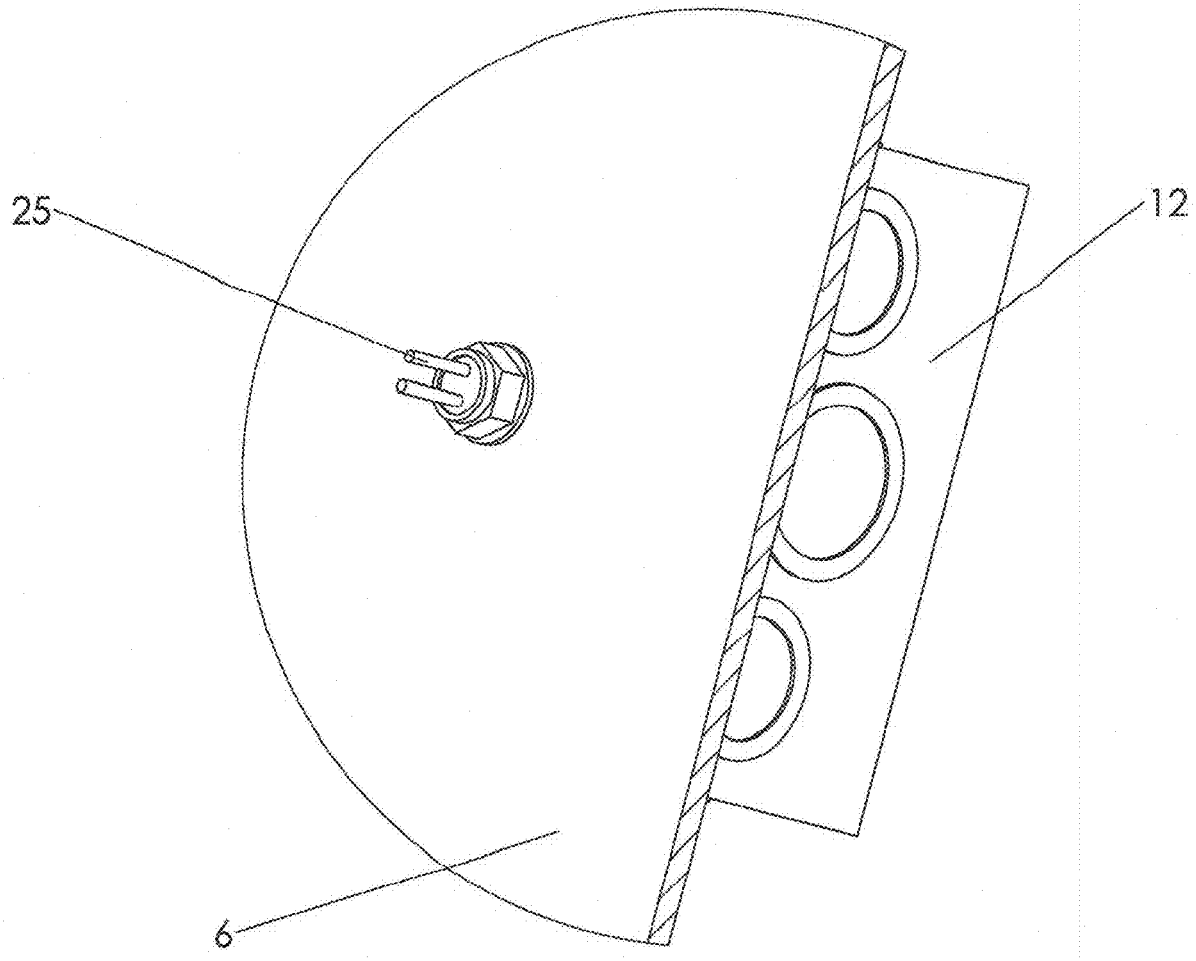
FIG. 10 is a detail view of the spark plug inside of the detonation chamber.

FIG. 10 is a detail view of the spark plug inside of the detonation chamber. In a preferred embodiment, the spark plug 25 is a custom-made spark plug comprised of a nylon threaded rod and stainless steel bolts. Because the explosions inside of the detonation chamber are so violent, ceramic spark plugs tend to shatter.

Figure 11:
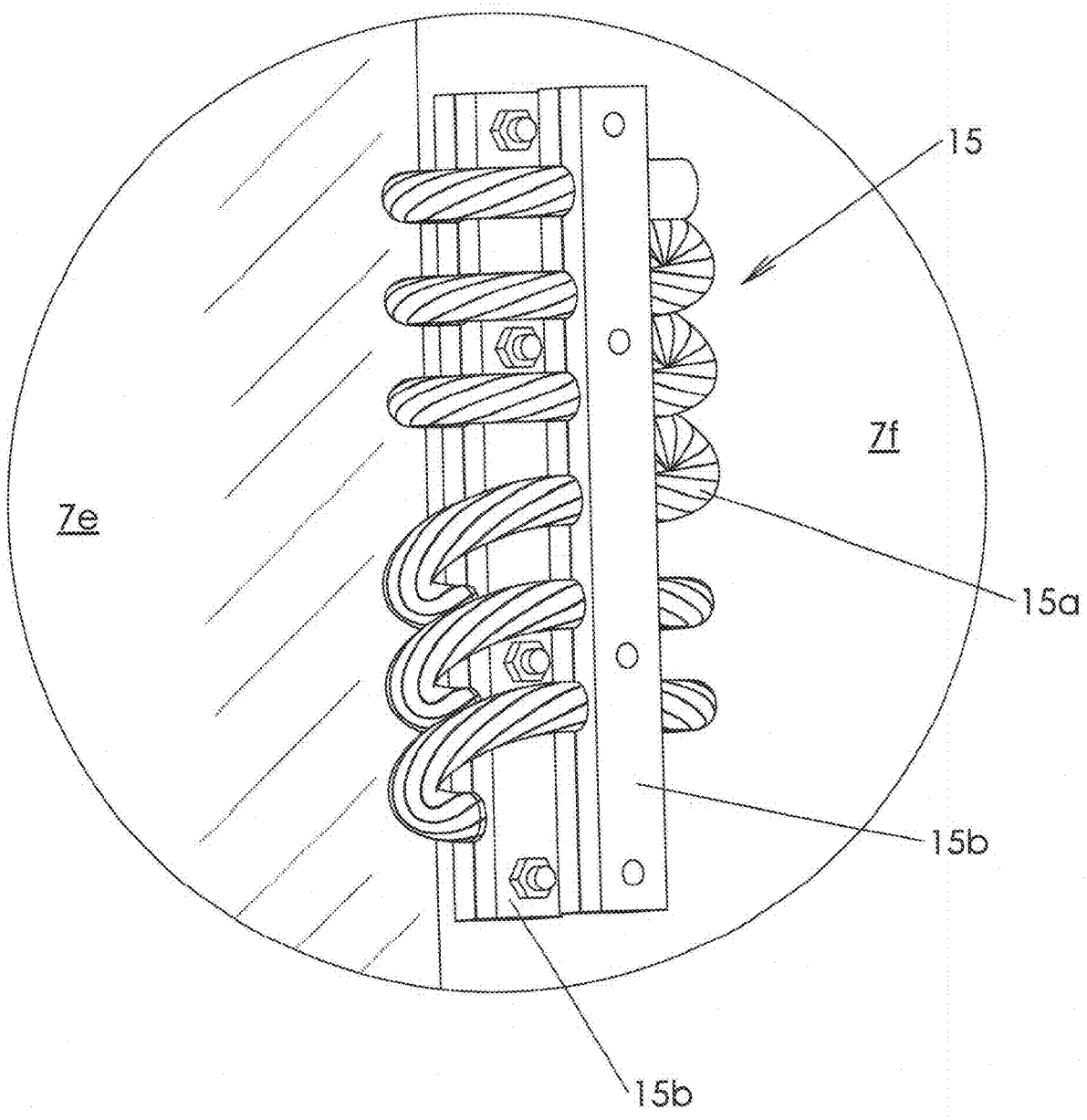
FIG. 11 is a detail view of the isolator spring of the present invention.

FIG. 11 is a detail view of the isolator spring of the present invention. In a preferred embodiment, the isolator spring 15 is a modified version of the M Series Wire Rope Isolator manufactured by Isolation Dynamics Corporation of Farmingdale, New York. As shown in this figure, each isolator spring is comprised of two aluminum bars through which a single wire rope cable is helically threaded. As shown in FIG. 8, the present invention includes four isolator springs 15, each of which is attached to both mounting brackets 7*a*, 7*d*. In a preferred embodiment, each isolator spring 15 is configured to provide one inch of movement at a pull force of 4000 pounds on the bolts that secure the isolator spring to the mounting bracket.

C. Installation and Operation of the System

The tower and detonation chamber are installed in an avalanche starting zone. The tower is attached to anchor bolts, which are permanently fixed into the concrete base. The concrete base is prepped and poured onsite, typically in remote and rugged mountainous terrain.

The detonation chamber is fixed to the tower at an angle of fifteen (15) degrees and points down towards the snow surface. Between the detonation chamber and the tower is a series of shock absorbing coils/isolator springs that help to minimize the strain on the tower itself. Over time the impact of the explosions degrades the connection between the tower and the detonation chamber. When this happens, the detonation chamber can be replaced while the tower remains in place. Gas cylinders (some combination of oxygen, methane and hydrogen) are stored separately and within a reasonable distance (no closer than 30 meters and up to a kilometer) from the tower/detonation chamber. The cylinders are placed in a standard rack and anchored to the ground or a man-made surface (wooden, steel or concrete deck). A series of hoses and regulators are situated between the gas supply and the tower/detonation chamber. Hoses from the gas management system to the detonation chamber are preferably ½" polyethylene (PE) pipe. These pipes will be run inside of a conduit that is appropriate for the terrain. The conduit can be a thick wall, large diameter PE pipe for buried sections or for use in areas above ground where there is little to no chance of the pipe being damaged. Where the conduit must be run above ground and damage is likely, steel pipe or rigid polyvinyl chloride (PVC) pipe must be used. The gas cylinders attach to high-pressure gas lines with the appropriate fittings. The gas lines are then interrupted by a series of regulators that control the volume of gas being delivered through the system. The gas lines terminate at and are threaded into the detonation chamber.

This system has the ability to employ a vertical distance of five hundred (500) meters and a horizontal distance of one kilometer between the gas supply and the tower/detonation chamber. This is a unique feature of the system and has the potential to greatly reduce user costs. By having longer gas line runs, the location options for gas storage change from remote terrain only accessible by helicopter to locations closer to roads, trails and rail systems. By increasing location options, the user can potentially use wheeled and/or over-snow vehicles to resupply gas. A mixture of gases is delivered to the detonation chamber. The mixtures that have been used by the inventors in testing the present invention thus far are oxygen/methane and oxygen/hydrogen; the present invention is not limited to any particular gas mixture, however, as long as it is ignitable. Once the proper mixture and volume of gas is achieved within the detonation chamber, a spark is initiated and creates an explosion of the gases. The spark is achieved through a flow switch, as noted above.

The ignition system uses a gas flow switch with a set of single pole double throw (SPDT) contacts. The common contact connects to a 10,000 uF capacitor, the normally closed (NC) contact connects to a spark generator, and the normally open (NO) contact connects to a battery. When gas flow starts, the flow switch detects the pressure increase and closes the connection between the battery and the capacitor. When the flow stops, the pressure drops, and the capacitor discharges into the spark generator, which sends high voltage to a spark plug, thereby igniting the gas mixture. This system is designed to optimize the detonation timing. It is imperative that the gas mixture ignites immediately after gas flow stops; this timing ensures that the oxygen and methane are still mixed evenly in the detonation chamber, allowing for optimal explosion velocity.

In the event of a misfire, the system is purged using nitrogen. This is done on a ten-minute cycle. After the system is purged, the user can safely troubleshoot the system without risk of detonation.

Snowpack assessment and avalanche forecasting require the user/operator to have a well-developed understanding of snowpack structure, fracture mechanics and meteorological influences on the snowpack. The user/operator is responsible for understanding when the time is right for attempting to trigger an avalanche and for deciding which mitigation efforts to employ. The present invention is designed to be used when the user/operator deems the snowpack unstable and capable of releasing avalanches from the trigger point.

There are four factors that must be present for an avalanche to occur: (i) a slab; (ii) a weak layer; (iii) terrain steep enough to produce avalanches; and (iv) a trigger. When the overlying slab or the underlying weak layer or both are at a critical point, the user introduces a trigger such as an air blast to create avalanches. The overpressure values created by gas-based systems have proven to be effective in generating avalanches. It is important to install the exploder in the best location possible for avalanche initiation. This process involves detailed terrain analysis, as well as snowpack and weather history. The pressure wave that is emitted from the detonation chamber creates enough impact on the snow (slab and weak layer) to initiate an avalanche.

D. Advantages of the Present Invention Over Prior Art

The present invention has numerous advantages over the prior art. The gas management system of the present invention is kept unpressurized to minimize the potential of leaks. In addition, there are fewer component parts than in existing RACS, which results in a less complex system with fewer potential fail points. A major complaint of other gas-based systems by users/operators is the prevalence of leaks within the system. Pressurized gas contained within lines and passing through a series of metal fittings tends to leak when subjected to wide temperature swings. Some mountainous locations where the present invention may be installed might experience temperature swings of 100 degrees Fahrenheit over the course of a year. The present invention also incorporates longer gas lines than in conventional avalanche control systems. With the present invention, operators have the ability not only to run gas lines uphill but also to run them for long distances, thereby reducing dependence on helicopters, increasing reliability, and decreasing operating costs. Initial testing has shown the potential to run lines up to 1 km in horizontal distance and 500 m in vertical rise. This flexibility allows users to install the gas supply in areas that are less expensive to access and to eliminate the use of a helicopter altogether.

The present invention also affords the user the ability to utilize different gas mixtures to create desired effects. Deeper snowpacks are generally safer than shallower snowpacks. The present invention enables the user to produce different shock waves to target the specific avalanche problem without wiping a slope clean. When repeatedly triggering avalanches in the same location over the course of the season, the snowpack immediately below the detonation chamber has the potential to remain shallow. When subjected to air and snowpack temperature swings, the snowpack is subjected to weakening due to a change in vapor pressure. This change is commonly referred to as a temperature gradient. When this steep gradient is present, vapor moves through the snowpack and recrystallizes at layer boundaries. This recrystallization allows for the formation of faceted snow grains, which are structurally weak. By themselves, facets do not pose a problem, but when overloaded by new snow in the form of slabs, the faceted layer of snow then becomes a weak layer that can fail more readily. By giving users the option of changing the peak and overall pressure on the snowpack through different gas mixtures and volumes, the user can decide how deeply to impact the underlying snowpack.

E. Dual-Head Side-by-Side Configuration

Figure 13:
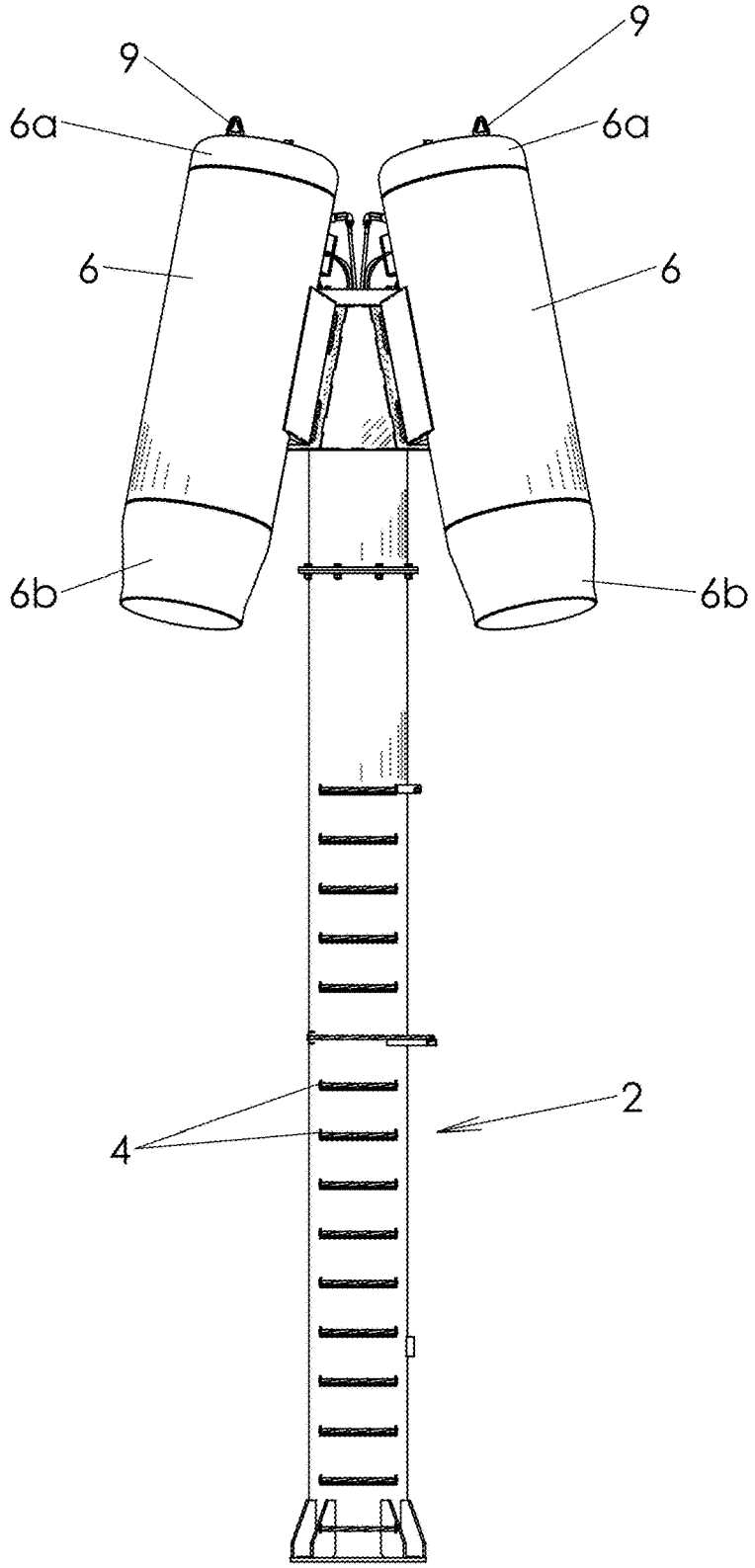
FIG. 13 is a front perspective view of a first alternate embodiment of the present invention in which two detonation chambers are mounted side-by-side on the tower.
Figure 14:
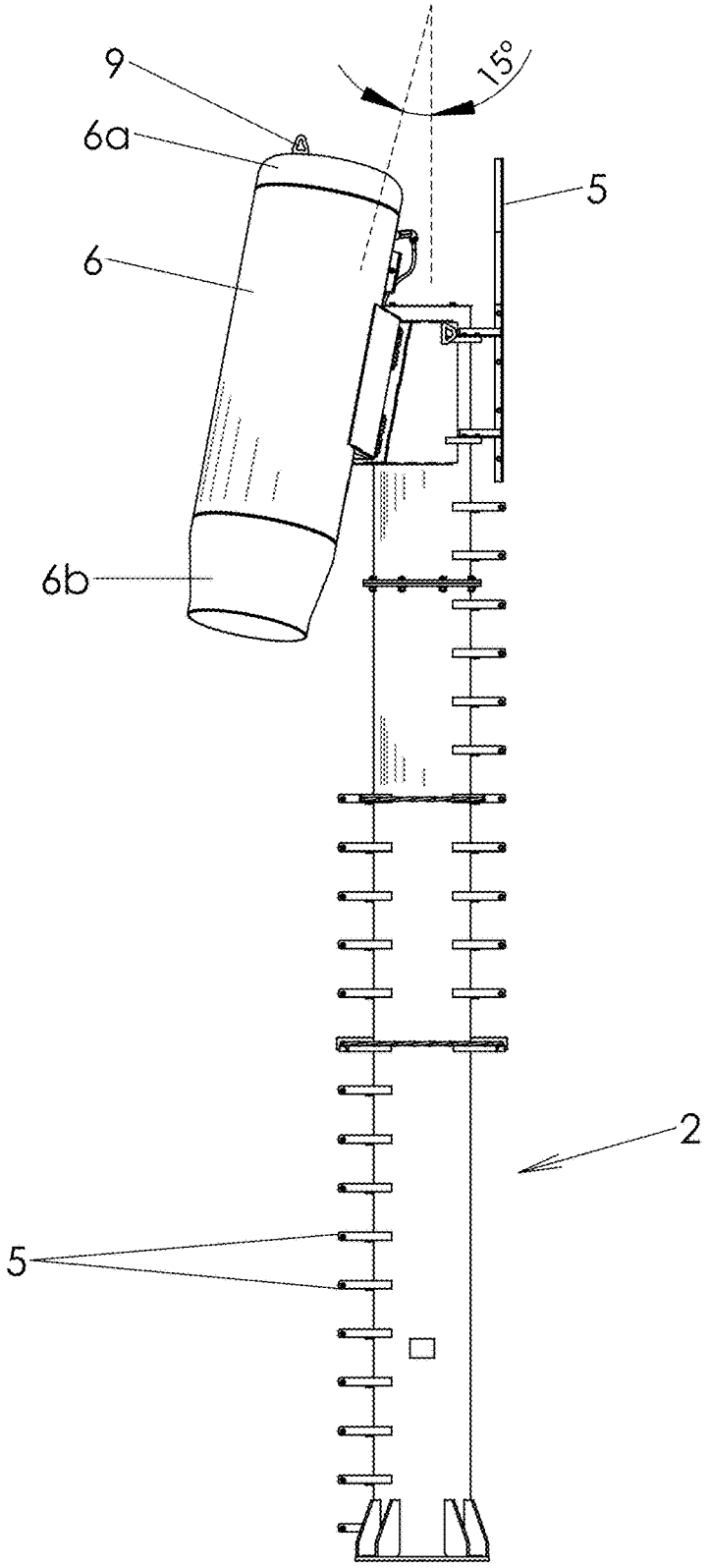
FIG. 14 is a first side view of a first alternate embodiment of the present invention in which two detonation chambers are mounted side-by-side on the tower.
Figure 15:
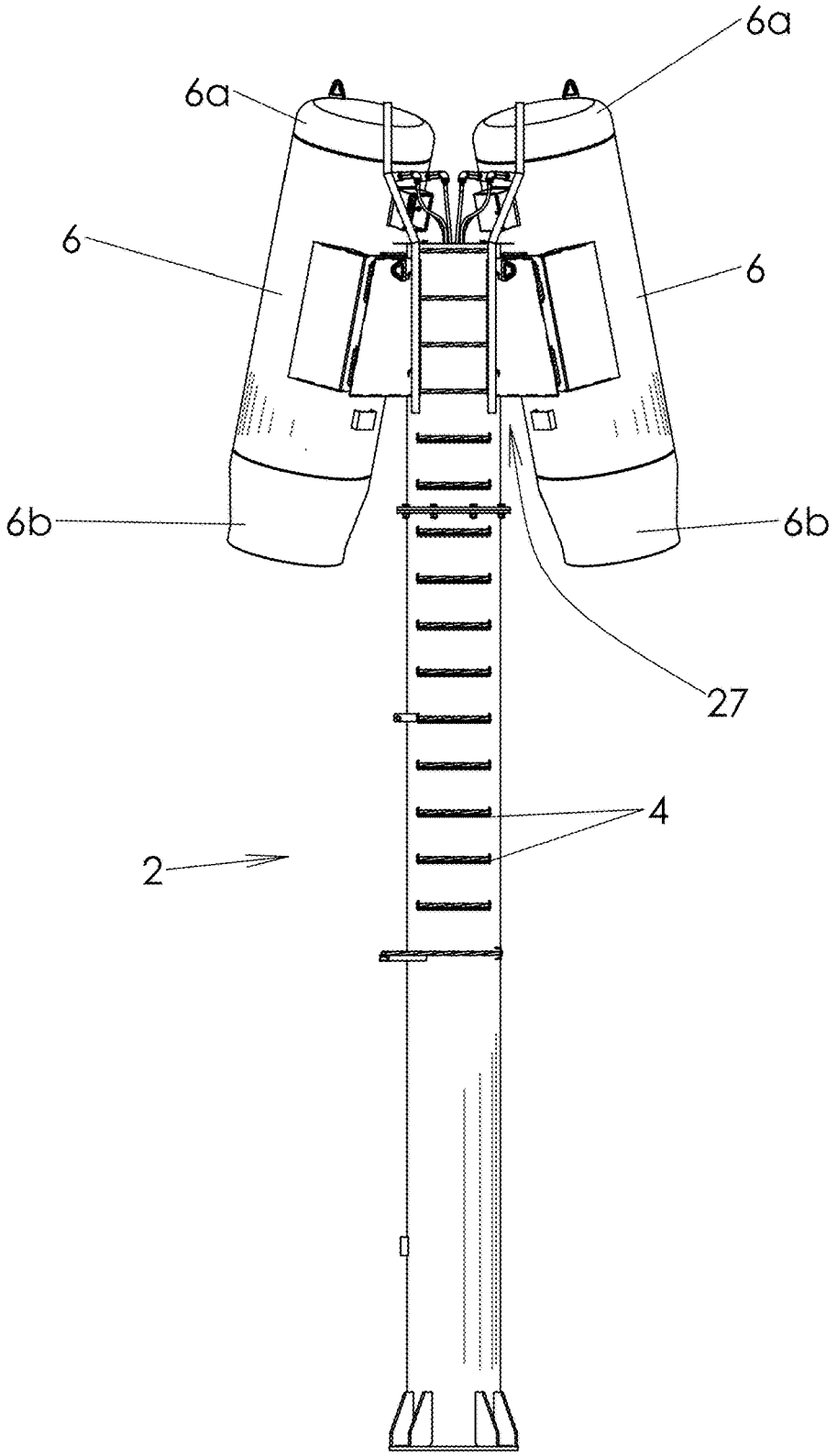
FIG. 15 is a rear view of a first alternate embodiment of the present invention in which two detonation chambers are mounted side-by-side on the tower.
Figure 16:
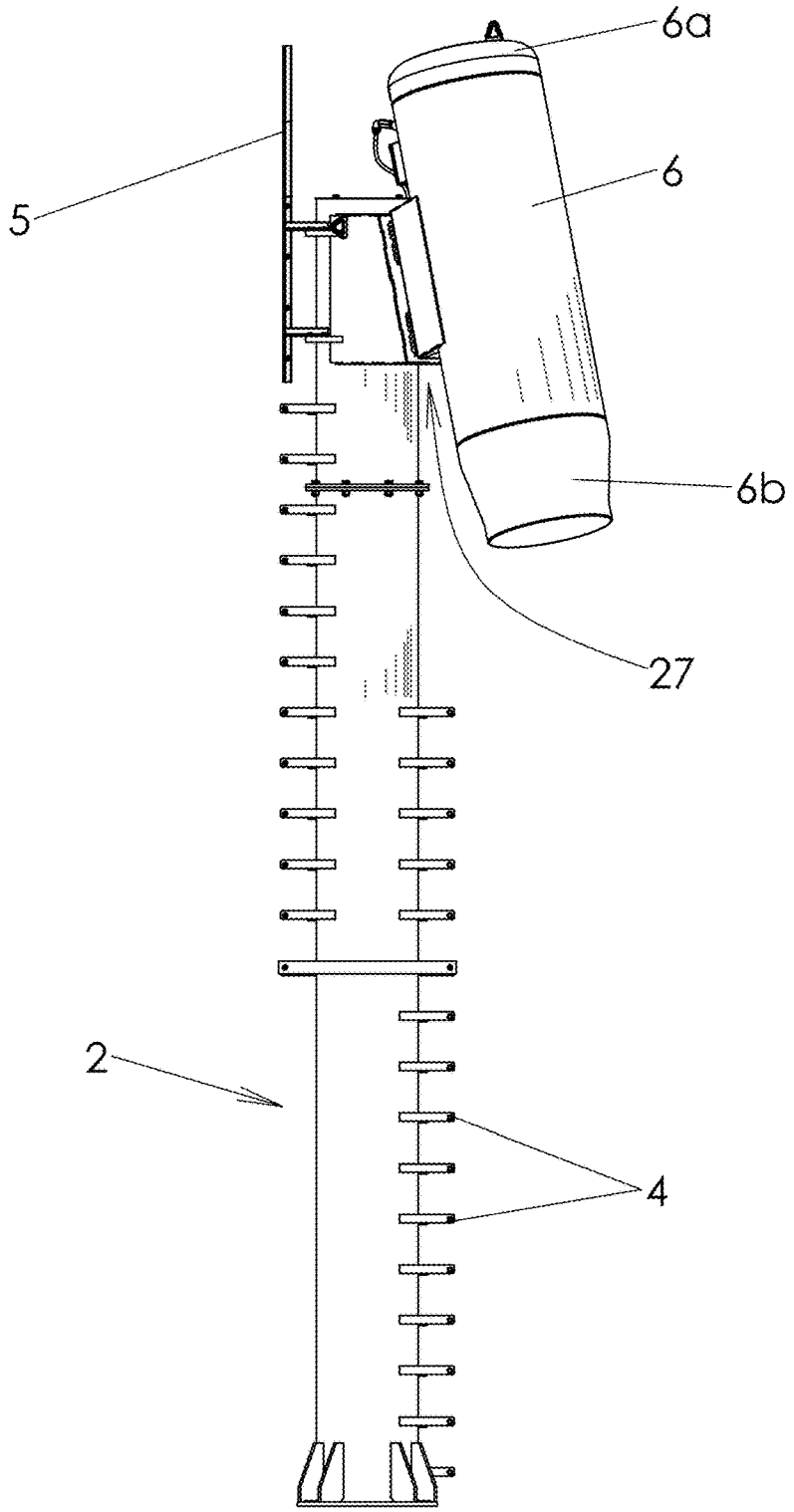
FIG. 16 is a second side view of a first alternate embodiment of the present invention in which two detonation chambers are mounted side-by-side on the tower.

FIG. 13-24 show an alternate embodiment of the present invention in which two detonation chambers are mounted side-by-side on the tower. FIG. 13 is a front perspective view of a first alternate embodiment of the present invention in which two detonation chambers are mounted side-by-side on the tower. FIG. 14 is a first side view, FIG. 15 is a rear view, and FIG. 16 is a second side view of the same alternate embodiment. This embodiment differs from the previously described embodiment in that two detonation chambers are mounted onto the tower in a side-by-side configuration, Although isolator springs are still incorporated in order to provide shock absorption during detonation, the mounting assemblies are different than described in connection with the first embodiment.

Figure 27:
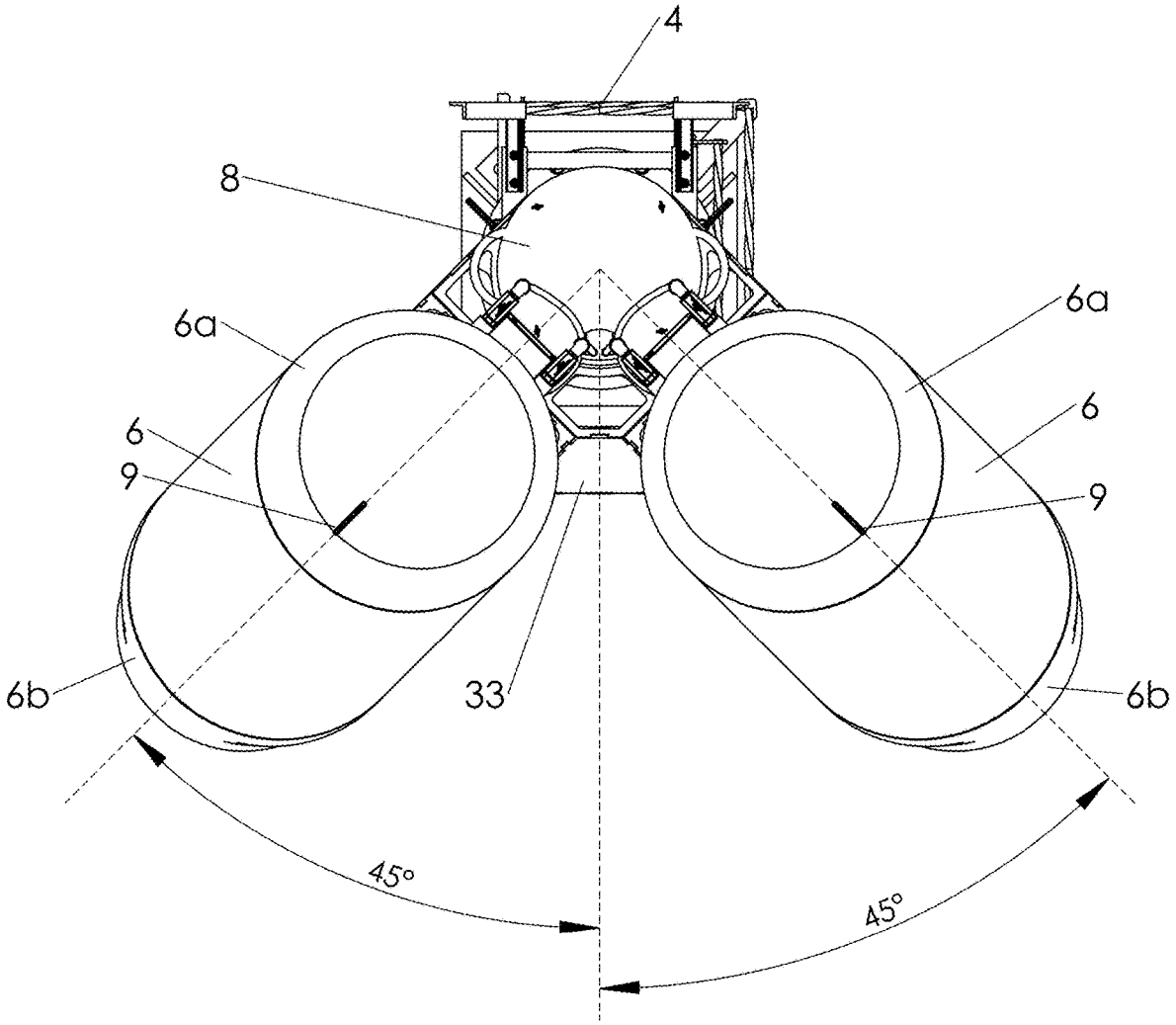
FIG. 27 is a top view of the first alternate embodiment of the present invention.

As shown in FIGS. 13-17, the ladder 4 preferably extends part of the way up the front side of the tower 2 and then continues on the back side of the tower 2 to the top of the tower, Note that the front side of the tower 2 preferably faces downhill (or down slope) when the invention is installed on the side of a mountain; therefore, snow will tend to accumulate on the back side of the tower (which faces uphill). In a preferred embodiment, each detonation chamber 6 is mounted at a forward angle of approximately fifteen degrees (15°) from the vertical axis of the tower 2 (see FIG. 14); in a preferred embodiment, this angle is in the range of ten (10) to twenty-five (25) degrees. In addition, the detonation chambers are preferably splayed sideways so that the bottom ends of the detonation chambers 6 are further away from each other than the top ends of the detonation chambers (see FIG. 27). The latter angle is preferably in the range of ninety (90) to one hundred eighty (180) degrees. Both of these angles are set at the time of manufacture depending on terrain requirements. The detonation chambers 6 are mounted to the tower with a central mounting assembly 27, which is described more fully below.

Figure 17:
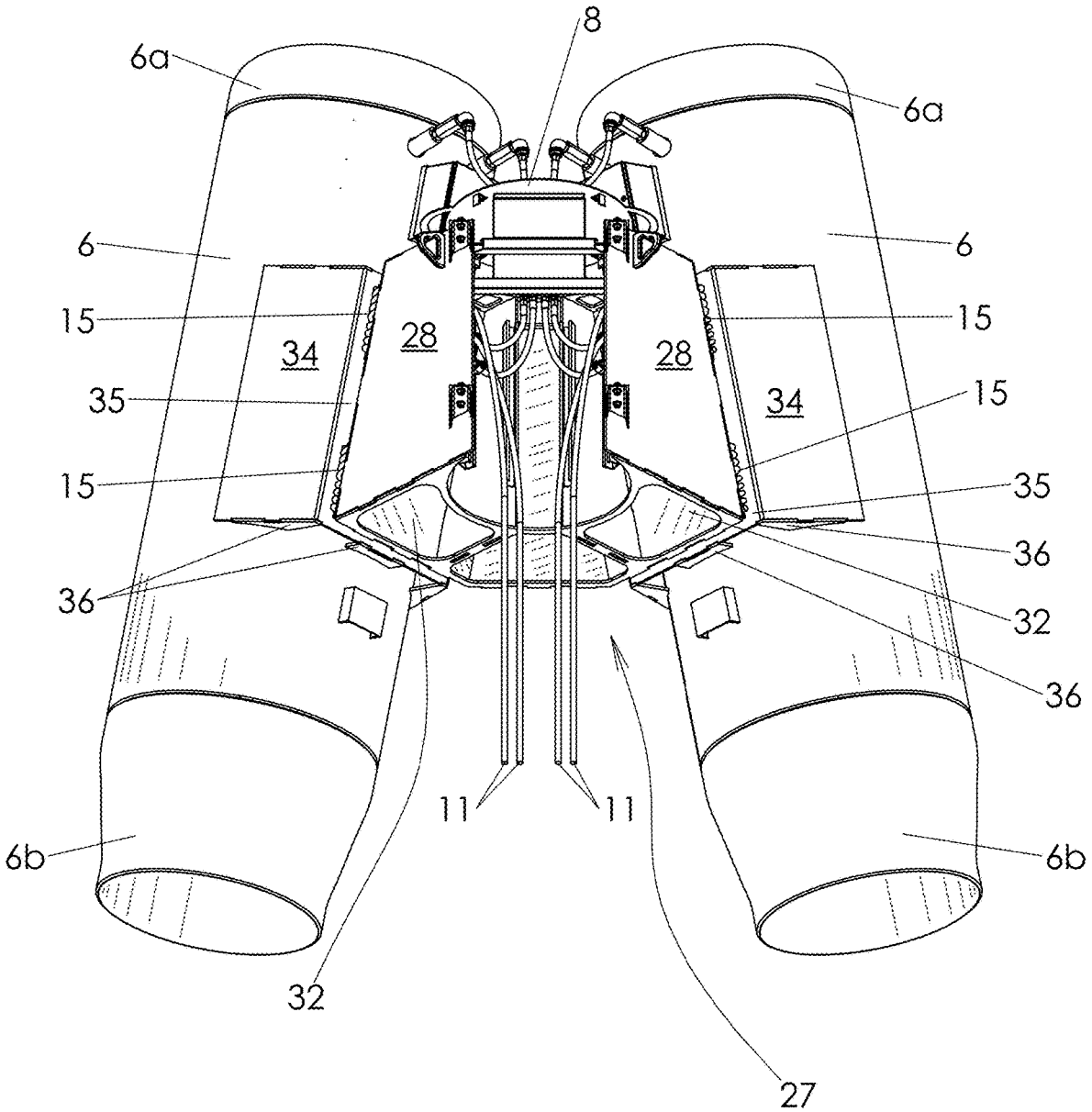
FIG. 17 is a bottom perspective view of the central mounting assembly, detonation chamber mounting assemblies, and detonation chambers of the first alternate embodiment.
Figure 18:
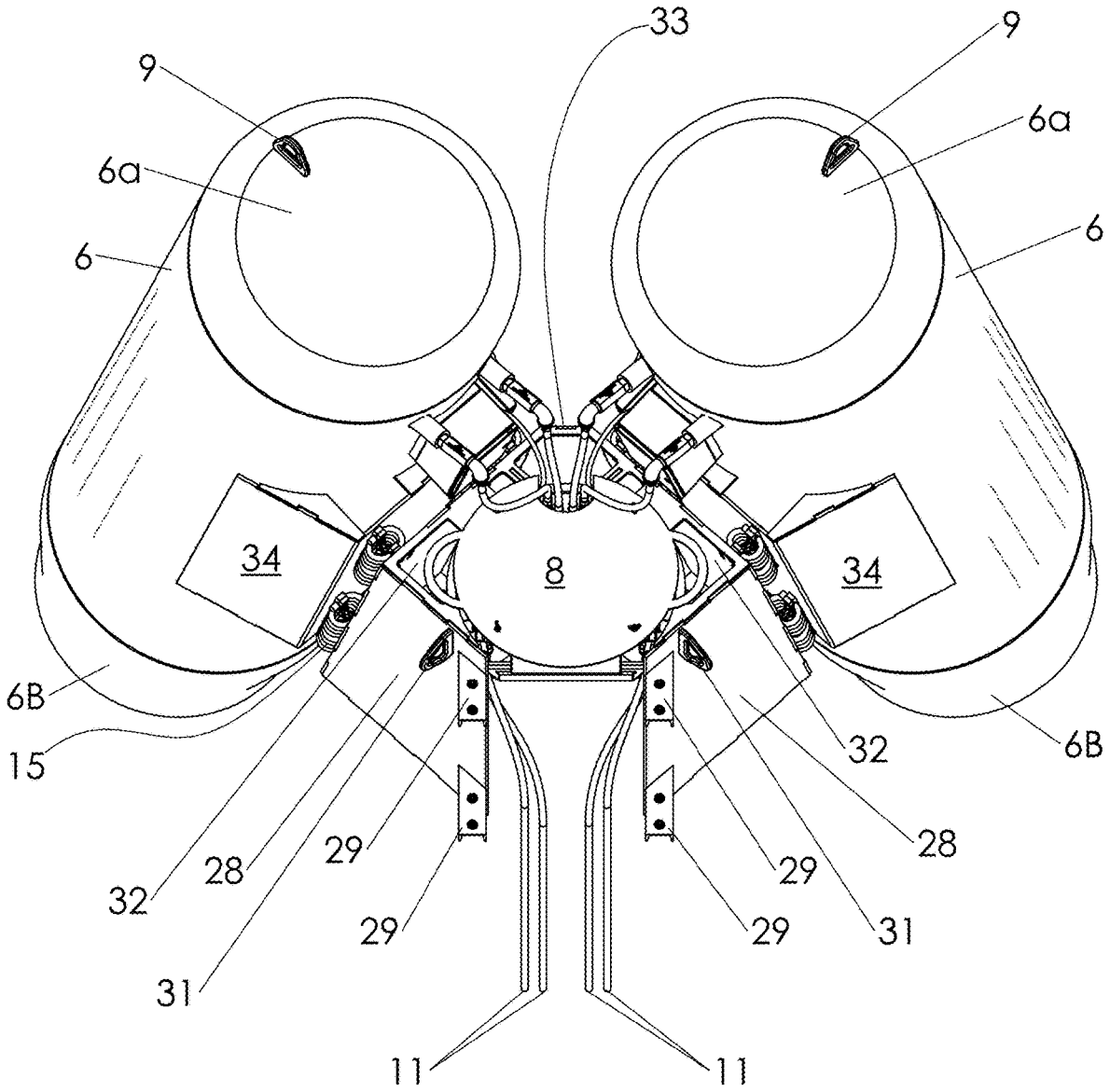
FIG. 18 is a top perspective view of the mountain assembly and detonation chambers of the first alternate embodiment.

FIG. 17 is a bottom perspective view, and FIG. 18 is a top perspective view, of the central mounting assembly, detonation chamber mounting assemblies, and detonation chambers of the first alternate embodiment. The tower 2 has been removed from these two figures for clarity. As shown in these two figures, the detonation chambers 6 are connected to the tower 2 (not shown) by a central mounting assembly 27 that is comprised of two rear plates 28 that are welded to the tower 2. Mounting brackets 29 and bolts 30 are used to secure the rear plates 28 to the handrail 5. A lifting lug 31 is situated at the top edge of each rear plate 28. Each rear plate 28 is connected to a side plate 32 at a ninety-degree (90°) angle. Isolator springs 15 are situated at each of the four corners of each side plate 32. A main gusset plate 33 (see also FIG. 20) connects the two side plates 32. Each detonation chamber 6 has its own mounting assembly (referred to herein as the "detonation chamber mounting assembly") comprised of two side plates 34 and a central plate 35 that is situated between the two side plates. The central plate 35 of each detonation chamber 6 is connected to one of the two side plates 32 of the central mounting assembly 27 via the isolator springs 15. Optional gusset plates 36 are included throughout the mounting assemblies for strength. This figure shows two pairs of gas supply lines 11, one pair for each detonation chamber 6.

Figure 19:
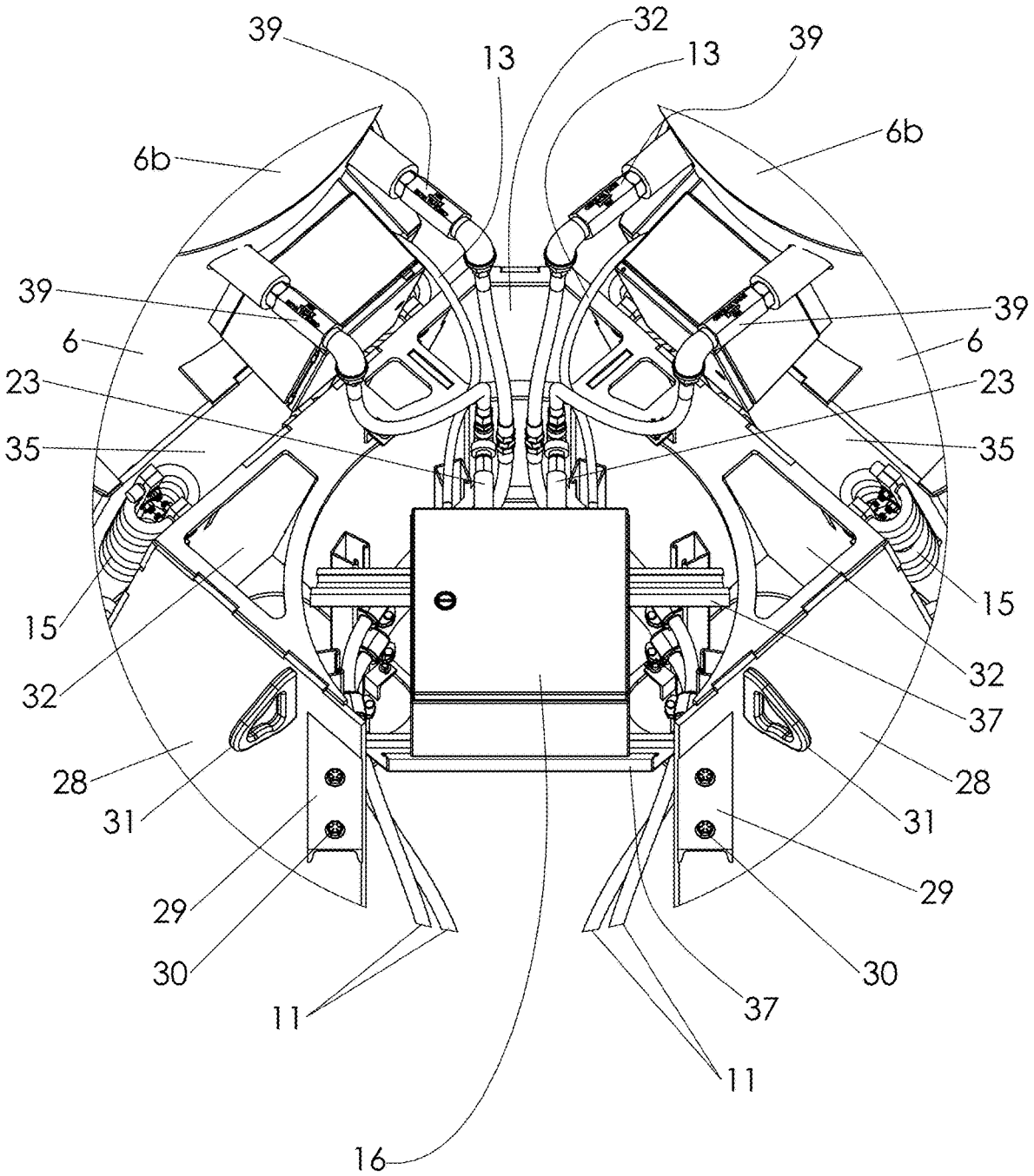
FIG. 19 is the same view as FIG. 18 except that the cover plate has been removed.

FIG. 19 is the same view as FIG. 18 except that the cover plate has been removed. In this embodiment, the ignition box 16 is situated directly underneath the cover 8 (not shown) and supported by two brackets 37 for case of access. Because this embodiment incorporates two detonation chambers, the ignition box contains two batteries, two capacitors, and two igniter switches. There are two flow switches 23 connected to the ignition box 16 (one for each detonation chamber); the flow switches operate in the same manner as described above in connection with FIG. 9. The flow switches 23 are preferably wired so that if one flow switch is activated, the spark plugs 25 in both detonation chambers 6 will ignite (see FIG. 21). This ensures that both detonation chambers 6 will always fire at the same time. The signal wire 22 is not visible in this figure because it is contained within the ignition box 16 (see FIG. 23). Note that the check valve 39 is labeled in this figure.

Figure 20:
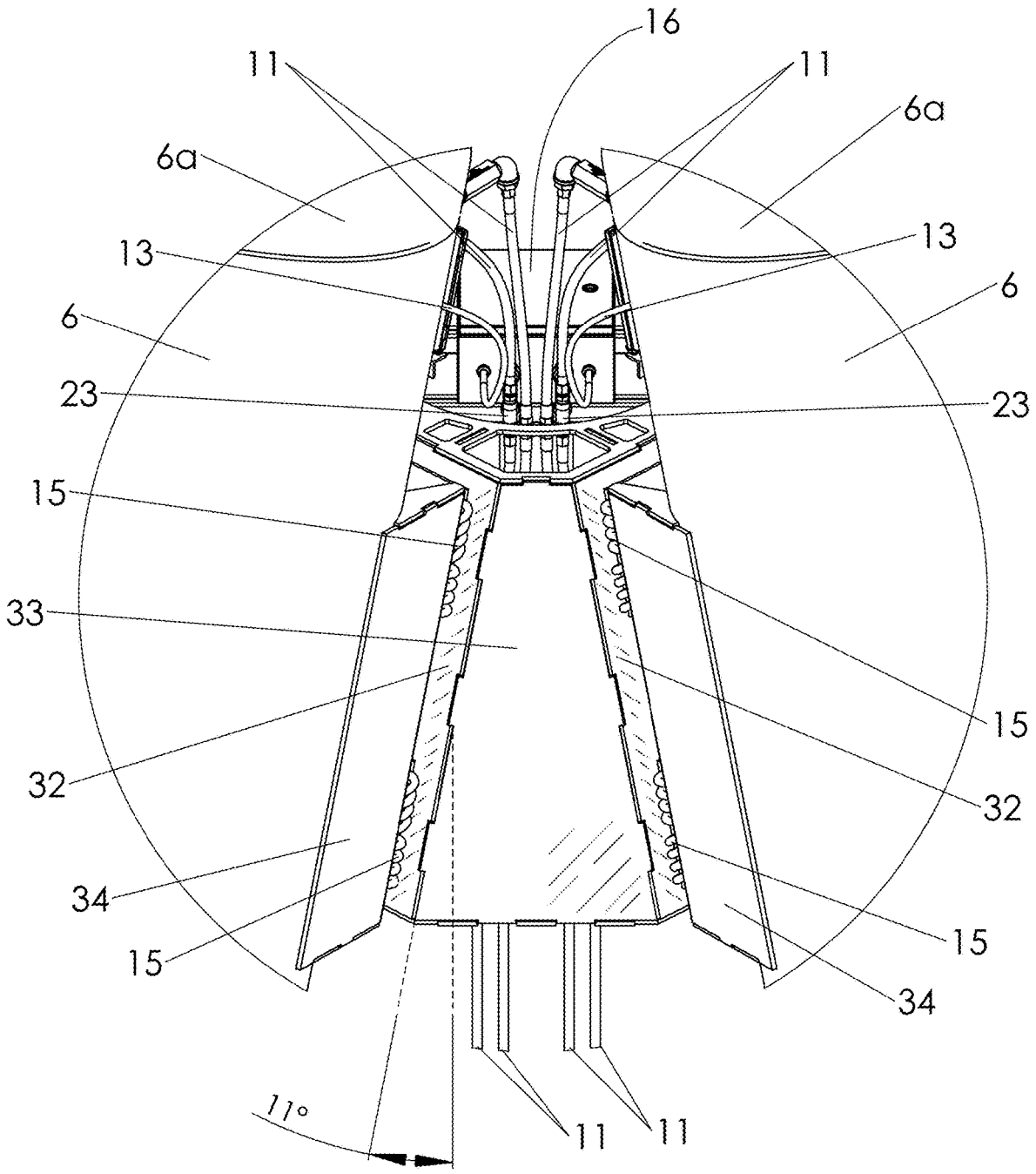
FIG. 20 is a front perspective view of the central mounting assembly, detonation chamber mounting assemblies, and detonation chambers of the first alternate embodiment.

FIG. 20 is a front perspective view of the central mounting assembly, detonation chamber mounting assemblies, and detonation chambers of the first alternate embodiment. The cover plate 8 has been removed from this figure for clarity. This figure clearly shows the main gusset plate 33, which expands in width from top to bottom (as shown here, at an angle of approximately eleven degrees (11°)). This figure also shows the side plates 34, which are shown more clearly in the next figure.

Figure 21:
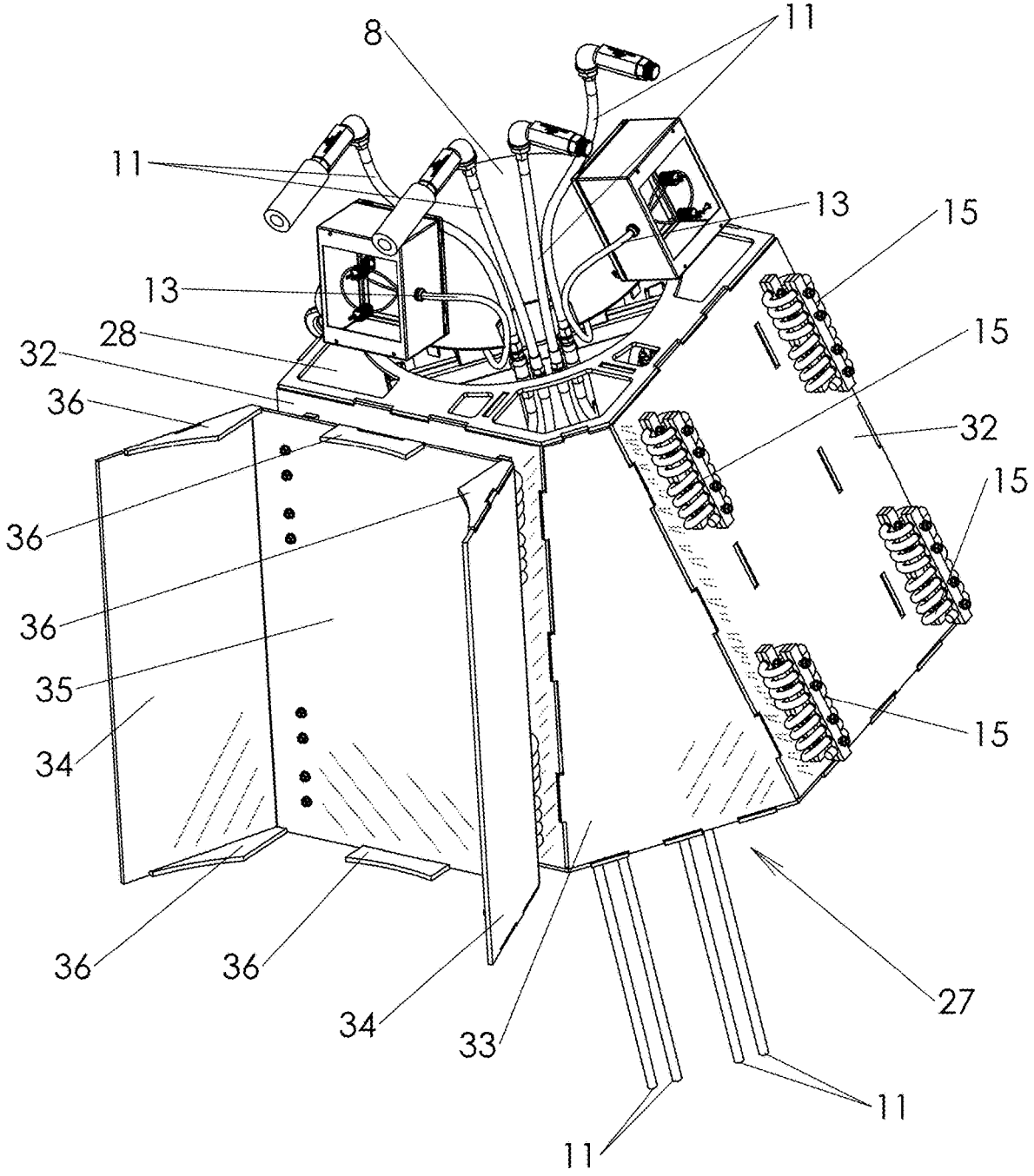
FIG. 21 is the same view as FIG. 20 except that both detonation chambers and the mounting brackets for one of the two detonation chambers have been removed.

FIG. 21 is the same view as FIG. 20 except that both detonation chambers and one of the detonation chamber mounting assemblies have been removed. The left-hand side of this figure shows one of the two detonation chamber mounting assemblies 38. As described above, each detonation chamber mounting assembly 38 is comprised of a central plate 35, two sides plates 34, and optional gusset plates 36. The isolator spring 15 are situated in between the central plate 35 of the detonation chamber mounting assembly 38 and the side plate 32 of the central mounting assembly 27 and are attached to both the central plate 35 and the side plate 32.

Figure 22:
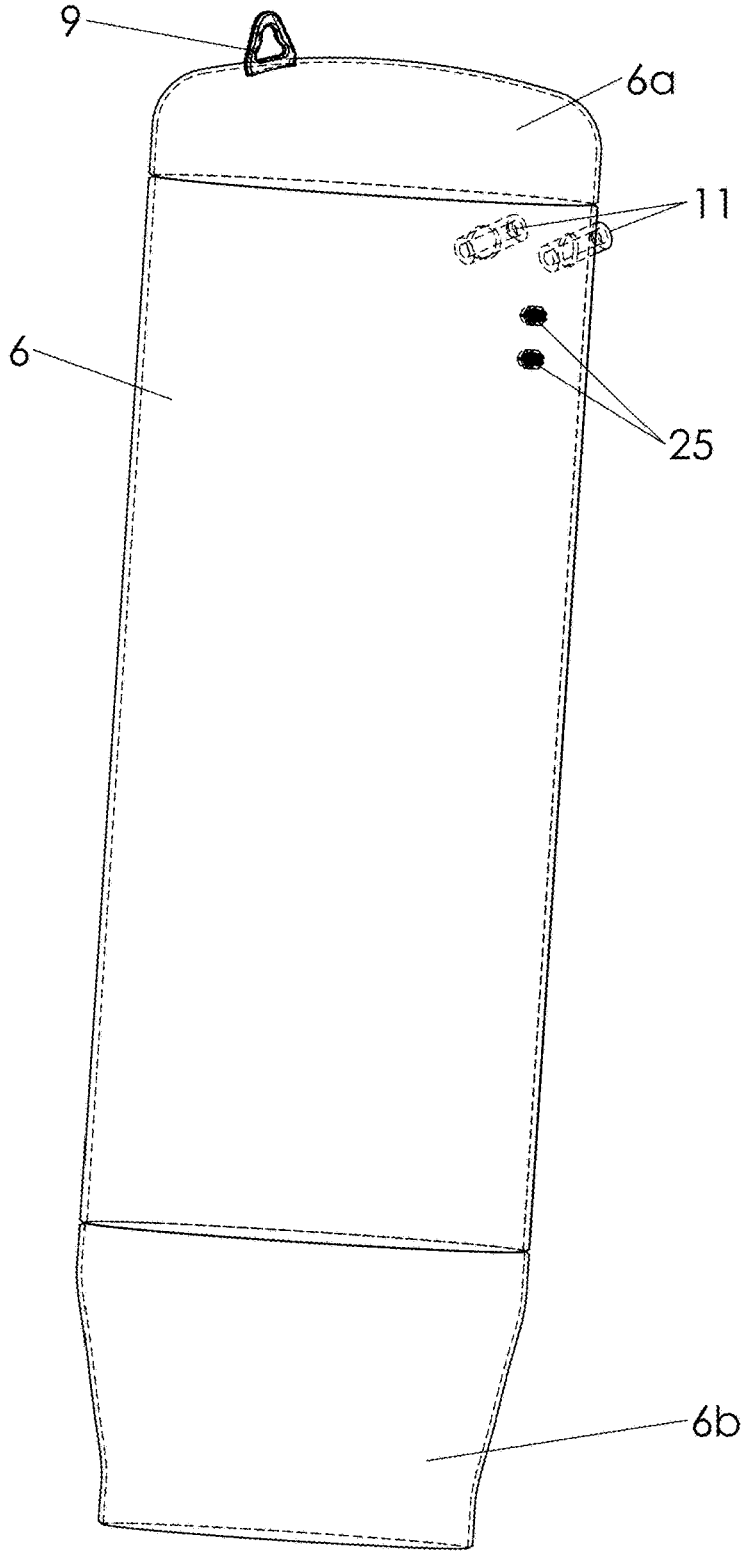
FIG. 22 is a shadow view of one of the two detonation chambers showing the inside of the detonation chamber.

FIG. 22 is a shadow view of one of the two detonation chambers showing the inside of the detonation chamber. As shown in this figure, two spark plugs 25 are situated on the wall of the detonation chamber 6, and two gas supply lines 11 supply gas to the detonation chamber 6. Two spark plugs are provided for redundancy.

Figure 23:
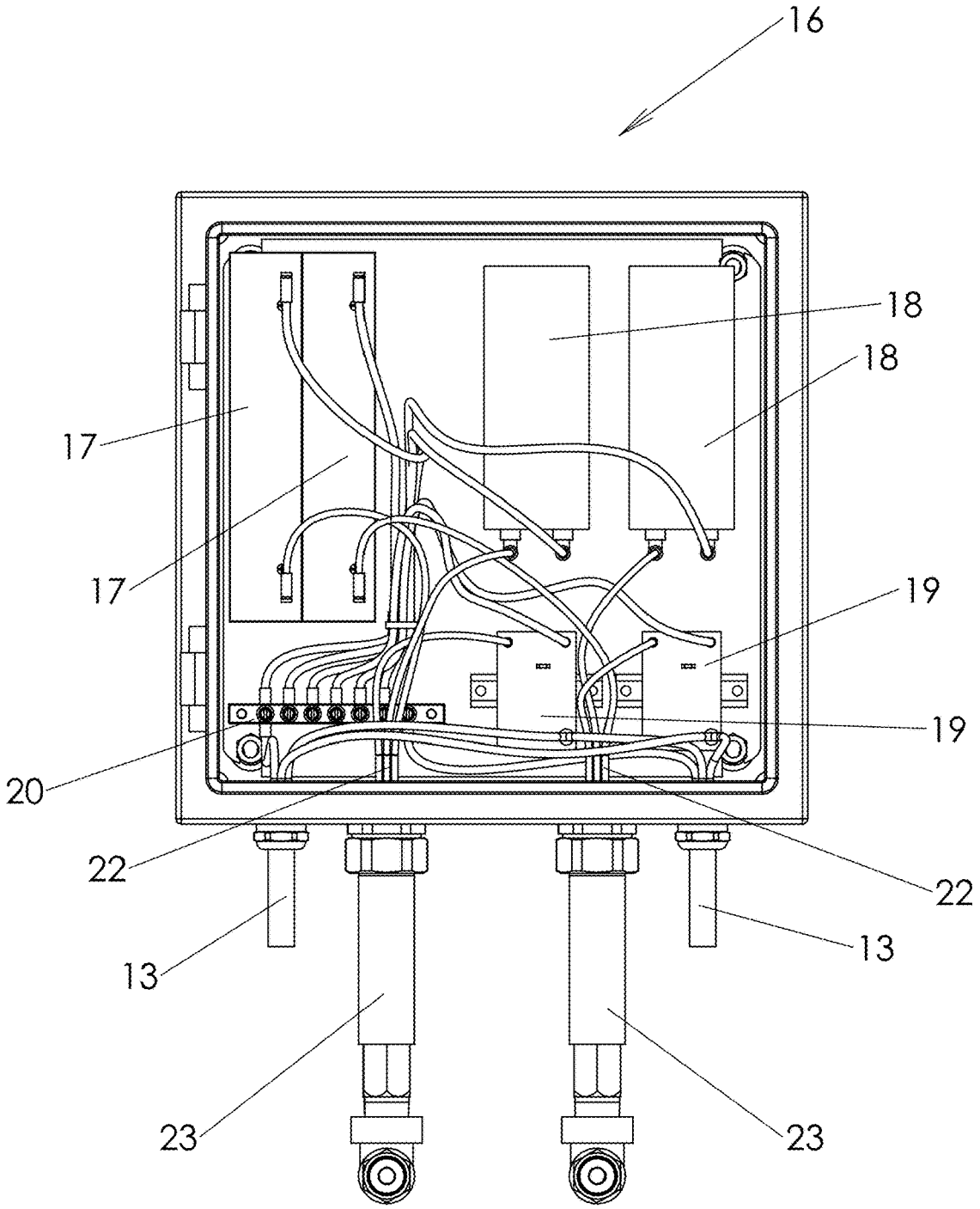
FIG. 23 is a front view of the contents of the ignition box of the first alternate embodiment of the present invention.

FIG. 23 is a front view of the contents of the ignition box of the first alternate embodiment of the present invention. All of the components within the ignition box 16 have been previously identified but are configured differently than in the initial embodiment to account for the fact that the invention now comprises two detonation chambers 6 rather than one. In this embodiment, the ignition box 16 preferably contains two batteries 17 and two voltage converters 19.

Figure 24:
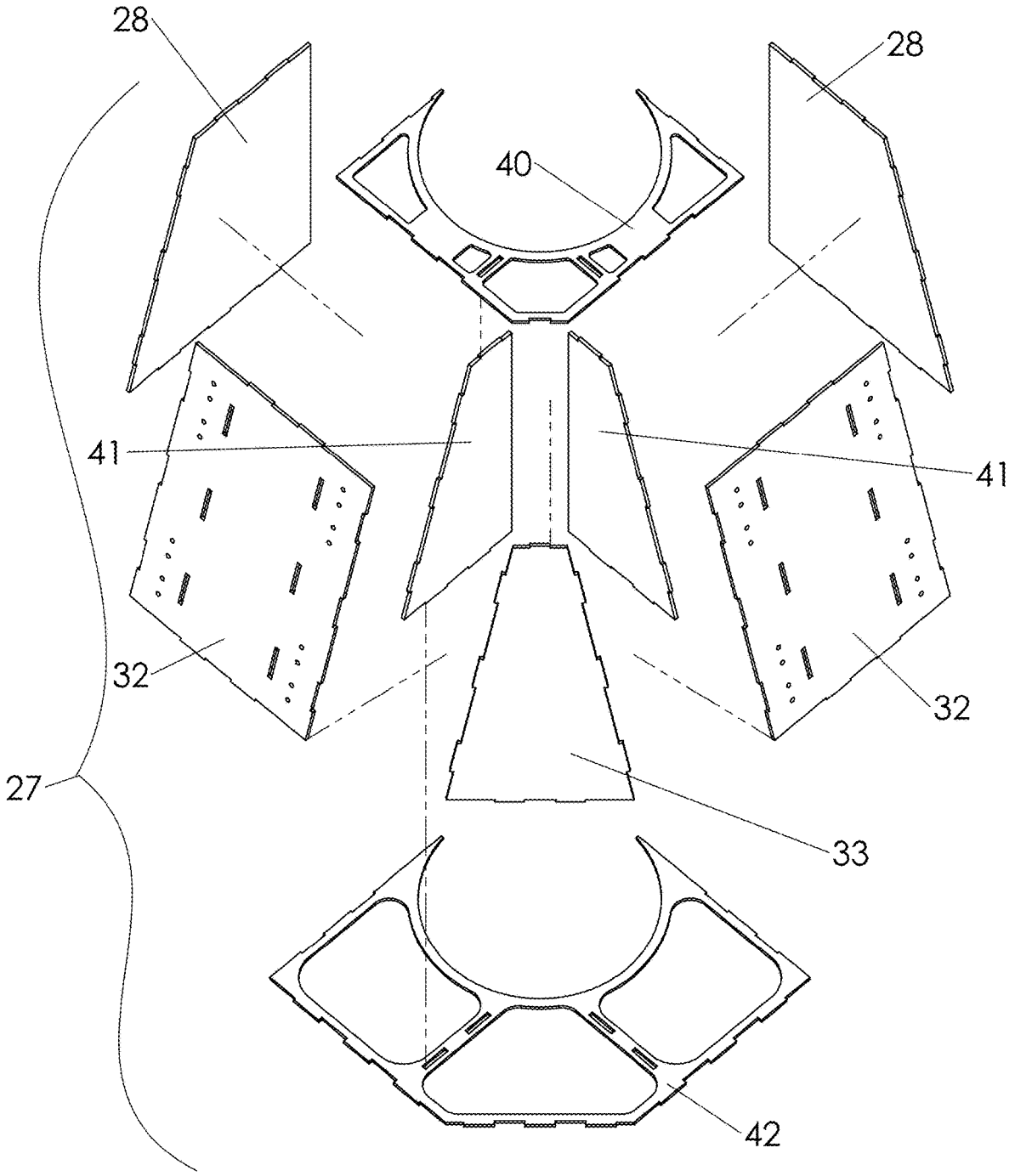
FIG. 24 is an exploded view of the central mounting assembly of the first alternate embodiment of the present invention.

FIG. 24 is an exploded view of the central mounting assembly of the first alternate embodiment of the present invention. As shown in this figure, the central mounting assembly 27 preferably comprises two rear plates 28, two side plates 32, and a main gusset plate 33. Two supporting plates 41 are preferably situated behind the side plates 32 to provide added support for the overall structure. A top frame 40 is roughly square in shape with a rearward opening and an interior recess configured to accept the outer circumference of the tower 2. The interior recess of the top frame 40 is preferably configured to surround approximately three-quarters (¾) of the tower (see also FIG. 26). The front edge of the top frame 42 is blunted (that is, the corner of the square has been eliminated) to create a front edge that is of the same width as the top edge of the main gusset plate 33. The top frame 40 defines the outer perimeter of the top of the central mounting assembly 27.

Figure 25:
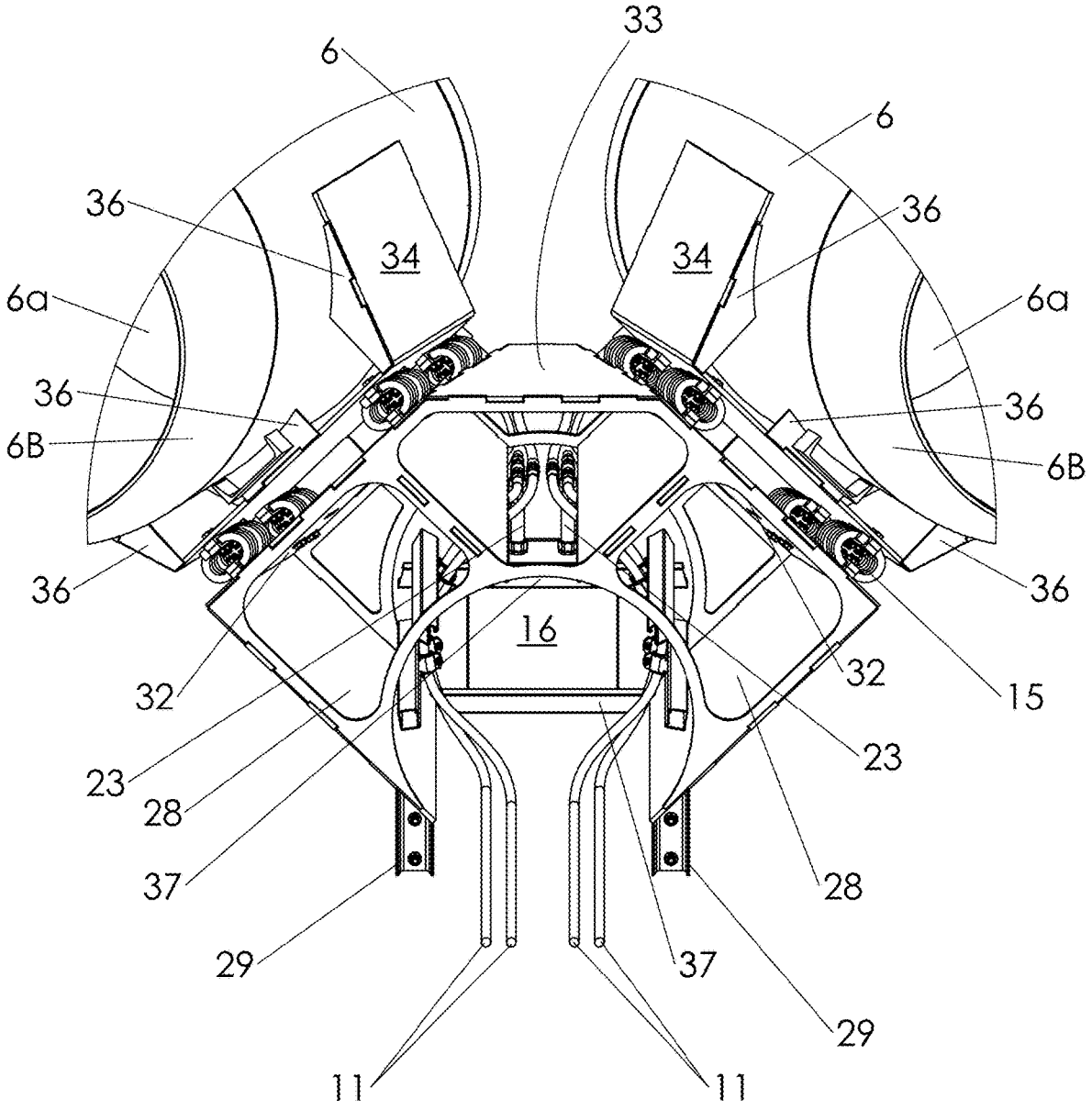
FIG. 25 is a bottom perspective view of the central mounting assembly of the first alternate embodiment of the present invention.

The central mounting assembly 27 also comprises a bottom frame 42 that is approximately square in shape with a rearward opening and an interior recess configured to accept the outer circumference of the tower 2. The interior recess of the bottom frame 42 is preferably configured to surround approximately three-quarters (¾) of the tower (see also FIG. 26). The front edge of the bottom frame 42 is blunted (that is, the corner of the square has been eliminated) to create a front edge that is of the same width as the bottom edge of the main gusset plate 33. The bottom frame 42 defines the outer perimeter of the bottom of the central mounting assembly 27 (see also FIG. 25). Note that the various component parts of the central mounting assembly 27 are preferably notched or keyed along their outer edges to form an interlocking grid with each adjacent surface; that is, with the exception of the rear edges of the rear plates 28 and the supporting plates 41, each outer edge of every component in the central mounting assembly 27 is comprised of a plurality of alternating keys (protrusions) and slots (indentations), and the pattern of alternating keys and slots on each such edge is configured to be coupled with an outer edge of an adjacent central mounting assembly component. By way of example, the front edge of the rear plate 28 is configured to couple or engage in an interlocking manner with the rear edge of the side plate 32. Similarly, the bottom edge of the main gusset plate 33 is configured to couple or engage in an interlocking manner with the front edge of the bottom frame 42, etc.

Figure 26:
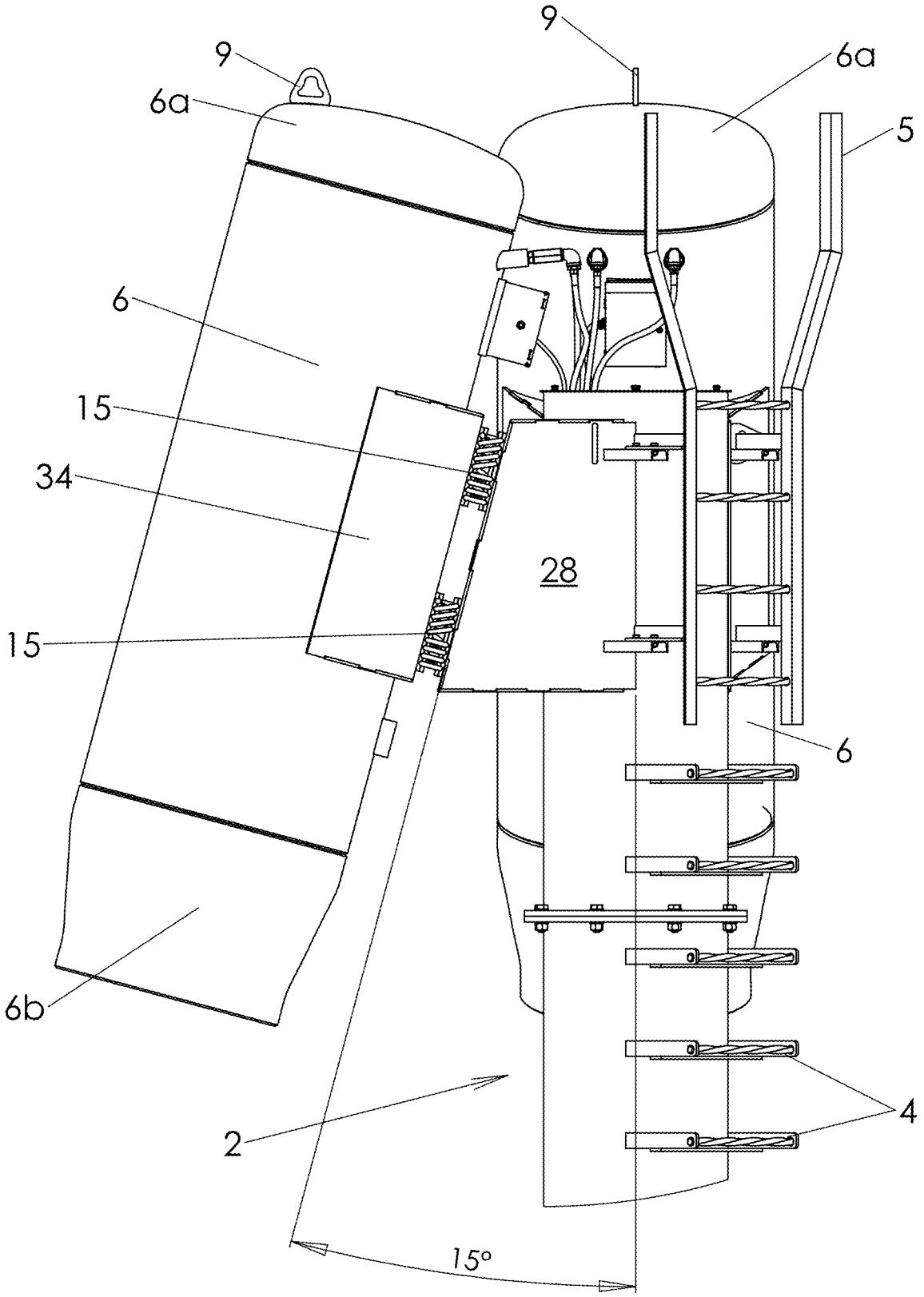
FIG. 26 is a side view of the first alternate embodiment of the present invention.

FIG. 26 is a side view of the first alternate embodiment of the present invention. As noted above (and illustrated in FIG. 14), the detonation chambers 6 are preferably mounted at an angle of approximately fifteen degrees (15°) from the vertical axis of the tower 2, but this angle is adjustable at the time of manufacture to accommodate the particular terrain on which the invention is installed; however, note that the front edge of the rear plate 28 is at the same angle as the detonation chamber 6 is to the tower 2. In this figure, that angle is also fifteen degrees (15°).

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. An avalanche triggering apparatus comprising:

(a) a tower having a first end, a second end, and a top part, the first end of the tower being connected to a base, and the top part of the tower being connected to two detonation chambers;

(b) two pairs of gas supply lines, each pair of gas supply lines being configured to deliver fuel gas and an oxidizer to one of the two detonation chambers;

(c) two spark plugs, each spark plug being configured to initiate combustion of gases within one of the two detonation chambers when activated by one of two flow switches;

(d) one or more batteries that are configured to provide electricity to the two spark plugs; and (e) means for controlling remotely a flow of gas through the two pairs of gas supply lines;

wherein the two detonation chambers are connected to the tower via a central mounting assembly, two detonation mounting assemblies, and a plurality of isolator springs disposed between the central mounting assembly and each of the two detonation mounting assemblies;

wherein the central mounting assembly is comprised of a main gusset plate, two side plates, two rear plates, a top frame, and a bottom frame;

wherein each of the two detonation mounting assemblies is comprised of a central plate and two side plates;

wherein each of the two detonation chambers comprises a closed top end and an open bottom end; and wherein the open bottom end of each of the two detonation chambers is configured to face a snow surface.

2. The avalanche triggering apparatus of claim 1, wherein the top frame of the central mounting assembly is roughly square in shape with a rearward opening and an interior recess that is configured to accept an outer circumference of the tower;

wherein the interior recess of the top frame is configured to surround approximately three-quarters of the outer circumference of the tower; and wherein a front edge of the top frame has a width that is equal to a width of a top edge of the main gusset plate.

3. The avalanche triggering apparatus of claim 1, wherein the bottom frame of the central mounting assembly is roughly square in shape with a rearward opening and an interior recess that is configured to accept an outer circumference of the tower;

wherein the interior recess of the bottom frame is configured to surround approximately three-quarters of the outer circumference of the tower; and wherein a front edge of the bottom frame has a width that is equal to a width of a bottom edge of the main gusset plate.

4. The avalanche triggering apparatus of claim 1, wherein each of the top frame, two rear plates, two sides plates, main gusset plate, and bottom frame of the central mounting assembly comprises a plurality of alternating keys and slots on at least one outer edge.

5. The avalanche triggering apparatus of claim 1, wherein each of the two detonation chambers is positioned forwardly at a first angle in the range of ten degrees to twenty-five degrees relative to a vertical axis of the tower.

6. The avalanche triggering apparatus of claim 5, wherein each of the two rear plates of the central mounting assembly has a front edge that is angled downwardly away from the vertical axis of the tower at a second angle; and wherein the second angle is equal to the first angle.

7. The avalanche triggering apparatus of claim 1, wherein each of the two detonation chambers comprises a bottom end, and wherein each of the two detonation chambers is splayed sideways so that the bottom ends of the two detonation chambers are at an angle in the range of ninety degrees to one hundred eighty degrees relative to each other.

8. The avalanche triggering apparatus of claim 1, wherein the central plate of the detonation chamber mounting assembly has four corners, and each of the two side plates of the central mounting assembly has four corners; and wherein the plurality of isolator springs are mounted on the four corners of the central plates of each of the two detonation chamber mounting assemblies and the four corners of each of the two side plates of the central mounting assembly.

9. The avalanche triggering apparatus of claim 1, wherein the two flow switches are configured so that the spark plugs in both detonation chambers will ignite upon activation by either of the two flow switches.

* * * * *